US009650858B2

(12) United States Patent
Williamson

(10) Patent No.: US 9,650,858 B2
(45) Date of Patent: May 16, 2017

(54) RESETTABLE PACKER ASSEMBLY AND METHODS OF USING THE SAME

(71) Applicant: Halliburton Energy Services, Inc., Houston, TX (US)

(72) Inventor: Jimmie Robert Williamson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 655 days.

(21) Appl. No.: 13/777,860

(22) Filed: Feb. 26, 2013

(65) Prior Publication Data

US 2014/0238700 A1 Aug. 28, 2014

(51) Int. Cl.

| | |
|---|---|
| ***E21B 33/128*** | (2006.01) |
| ***E21B 23/06*** | (2006.01) |
| ***E21B 33/129*** | (2006.01) |

(52) U.S. Cl.

CPC ..... *E21B 33/128* (2013.01); *E21B 23/06* (2013.01); *E21B 33/129* (2013.01)

(58) Field of Classification Search

USPC ..... 166/387, 118, 382, 123, 124, 181

See application file for complete search history.

(56) References Cited

U.S. PATENT DOCUMENTS

| | | | | |
|---|---|---|---|---|
| 4,109,725 | A | | 8/1978 | Williamson et al. |
| 4,113,018 | A | | 9/1978 | Barrington et al. |
| 4,144,937 | A | | 3/1979 | Jackson et al. |
| 5,048,613 | A | * | 9/1991 | Shilling ..... 166/387 |
| 5,259,457 | A | | 11/1993 | Williamson, Jr. |
| 5,293,943 | A | | 3/1994 | Williamson, Jr. |
| 5,348,087 | A | | 9/1994 | Williamson, Jr. |
| 5,390,735 | A | | 2/1995 | Williamson, Jr. |
| 5,566,763 | A | | 10/1996 | Williamson et al. |
| 5,613,559 | A | | 3/1997 | Williamson et al. |
| 5,617,918 | A | | 4/1997 | Cooksey et al. |
| 5,730,224 | A | | 3/1998 | Williamson et al. |
| 5,954,135 | A | | 9/1999 | Williamson et al. |
| 5,992,525 | A | | 11/1999 | Williamson et al. |
| 6,009,942 | A | | 1/2000 | Williamson |
| 6,092,593 | A | | 7/2000 | Williamson et al. |
| 6,422,317 | B1 | | 7/2002 | Williamson, Jr. |
| 6,536,530 | B2 | | 3/2003 | Schultz et al. |

(Continued)

FOREIGN PATENT DOCUMENTS

| | | |
|---|---|---|
| GB | 2100320 A | 12/1982 |
| GB | 2300441 A | 11/1996 |

OTHER PUBLICATIONS

International Search Report and Written Opinion issued in related application PCT/US2014/015592, mailed on Mar. 2, 2015, 9 pages.

*Primary Examiner* — Taras P Bemko

(74) *Attorney, Agent, or Firm* — John W. Wustenberg; Baker Botts L.L.P.

(57) ABSTRACT

A wellbore servicing tool is disclosed, which includes a packer element that exhibits radial expansion upon being longitudinally compressed, wherein the packer element is movably positioned about a mandrel generally downward relative to an upper housing, wherein the wellbore servicing tool is selectively transitionable from an unset configuration to a set configuration or from the unset configuration to the set configuration upon rotation of the upper housing with respect to the mandrel.

20 Claims, 11 Drawing Sheets

(56) References Cited

U.S. PATENT DOCUMENTS

| | | | | |
|---|---|---|---|---|
| 6,668,936 | B2 | 12/2003 | Williamson, Jr. et al. | |
| 6,715,558 | B2 | 4/2004 | Williamson | |
| 7,370,709 | B2 | 5/2008 | Williamson, Jr. | |
| 7,510,010 | B2 | 3/2009 | Williamson | |
| 7,597,149 | B2 | 10/2009 | Williamson, Jr. et al. | |
| 7,597,151 | B2 | 10/2009 | Curtis et al. | |
| 7,640,989 | B2 | 1/2010 | Williamson, Jr. et al. | |
| 7,644,767 | B2 | 1/2010 | Kalb et al. | |
| 7,866,402 | B2 | 1/2011 | Williamson, Jr. | |
| 7,926,573 | B2 | 4/2011 | Swan et al. | |
| 8,038,120 | B2 | 10/2011 | Vick, Jr. et al. | |
| 8,096,363 | B2 | 1/2012 | Williamson, Jr. | |
| 8,235,103 | B2 | 8/2012 | Wright et al. | |
| 8,276,675 | B2 | 10/2012 | Williamson et al. | |
| 8,342,247 | B2 | 1/2013 | Vick, Jr. et al. | |
| 2006/0213656 | A1* | 9/2006 | Clifton | 166/125 |
| 2010/0051260 | A1 | 3/2010 | Vick, Jr. et al. | |
| 2010/0096134 | A1 | 4/2010 | Barlow et al. | |
| 2011/0042099 | A1 | 2/2011 | Williamson, Jr. et al. | |
| 2011/0240299 | A1 | 10/2011 | Vick, Jr. et al. | |
| 2011/0253383 | A1 | 10/2011 | Porter et al. | |
| 2012/0125597 | A1 | 5/2012 | Vick, Jr. et al. | |
| 2012/0211241 | A1 | 8/2012 | Williamson, Jr. et al. | |
| 2012/0241143 | A1 | 9/2012 | Wright et al. | |
| 2012/0261139 | A1 | 10/2012 | Williamson, Jr. et al. | |

* cited by examiner

RESETTABLE PACKER ASSEMBLY AND METHODS OF USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the drilling, servicing, completing, repairing, and/or reworking of wells (e.g., oil and/or gas wells), a great variety of downhole wellbore servicing tools are used. For example, but not by way of limitation, it is often desirable to isolate two or more portions of a wellbore in order to verify the integrity of a tubular (e.g., a casing string) deployed within a wellbore (e.g., in the performance of a pressure test) and/or to determine the presence and/or location of a leak. Additionally or alternatively, it may also be desirable to isolate various portions of a wellbore during the performance of a stimulation (e.g., perforating and/or fracturing) operation, during completion (such as cementing) operations, or in connection with various other servicing operations. Downhole wellbore servicing tools (i.e., isolation tools), for example, packers and/or plugs may be employed for these general purposes.

To be utilized in the isolation of various portions of a tubular, for example, during a pressure test operation, such isolation tools may be deployed at a desired and/or predetermined location within a wellbore. However, conventional isolation devices suffer from various shortcomings. As such, there exists a need for an improved downhole wellbore servicing tool (e.g., an isolation tool) and methods of utilizing the same.

SUMMARY

Disclosed herein is a wellbore servicing tool comprising a mandrel generally defining an axial flowbore and an outer cylindrical surface, at least a portion of the outer cylindrical surface comprising a threaded exterior surface, an upper housing generally defining a first inner cylindrical surface, at least a portion of the first inner cylindrical surface comprising a threaded interior surface, wherein the upper housing is movably positioned about at least a portion of the mandrel such that the threaded exterior surface at least partially engages the threaded interior surface, a packer element exhibiting radial expansion upon being longitudinally compressed, wherein the packer element is movably positioned about at least a portion of the mandrel generally downward relative to the upper housing, and a lower housing generally defining a second inner cylindrical surface, wherein the lower housing is movably positioned about at least a portion of the mandrel, wherein the wellbore servicing tool is selectively transitionable from an unset configuration to a set configuration upon a decrease in longitudinal distance between the upper housing and the lower housing along the mandrel, wherein the wellbore isolation tool is selectively transitionable from the set configuration to the unset configuration upon an increase in longitudinal distance between the upper housing and the lower housing, and wherein the rotation of the upper housing with respect to the mandrel decreases the longitudinal distance between the upper housing and the lower housing along the mandrel or increases longitudinal distance between the upper housing and the lower housing along the mandrel.

Also disclosed herein is a wellbore servicing system comprising a setting tool disposed within a wellbore, and a wellbore isolation tool selectively coupled to the setting tool and comprising a mandrel generally defining an axial flowbore and an outer cylindrical surface, at least a portion of the outer cylindrical surface comprising a threaded exterior surface, an upper housing generally defining a first inner cylindrical surface, at least a portion of the first inner cylindrical surface comprising a threaded interior surface, wherein the upper housing is movably positioned about at least a portion of the mandrel such that the threaded exterior surface at least partially engages the threaded interior surface, a packer element exhibiting radial expansion upon being longitudinally compressed, wherein the packer element is movably positioned about at least a portion of the mandrel generally downward relative to the upper housing, and a lower housing generally defining a second inner cylindrical surface, wherein the lower housing is movably positioned about at least a portion of the mandrel, wherein the wellbore isolation tool is selectively transitionable from an unset configuration to a set configuration upon a decrease in longitudinal distance between the upper housing and the lower housing along the mandrel, wherein the wellbore isolation tool is selectively transitionable from the set configuration to the unset configuration upon an increase in longitudinal distance between the upper housing and the lower housing, and wherein the rotation of the upper housing with respect to the mandrel moves decreases the longitudinal distance between the upper housing and the lower housing along the mandrel or increases longitudinal distance between the upper housing and the lower housing along the mandrel.

Further disclosed herein is a wellbore servicing method comprising positioning a wellbore isolation tool within a wellbore, wherein the wellbore isolation tool is positioned within the wellbore selectively coupled to a setting tool, and setting the wellbore isolation tool, wherein setting the wellbore isolation tool comprises causing an upper housing of the wellbore isolation tool to rotate with respect to a mandrel of the wellbore isolation tool.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
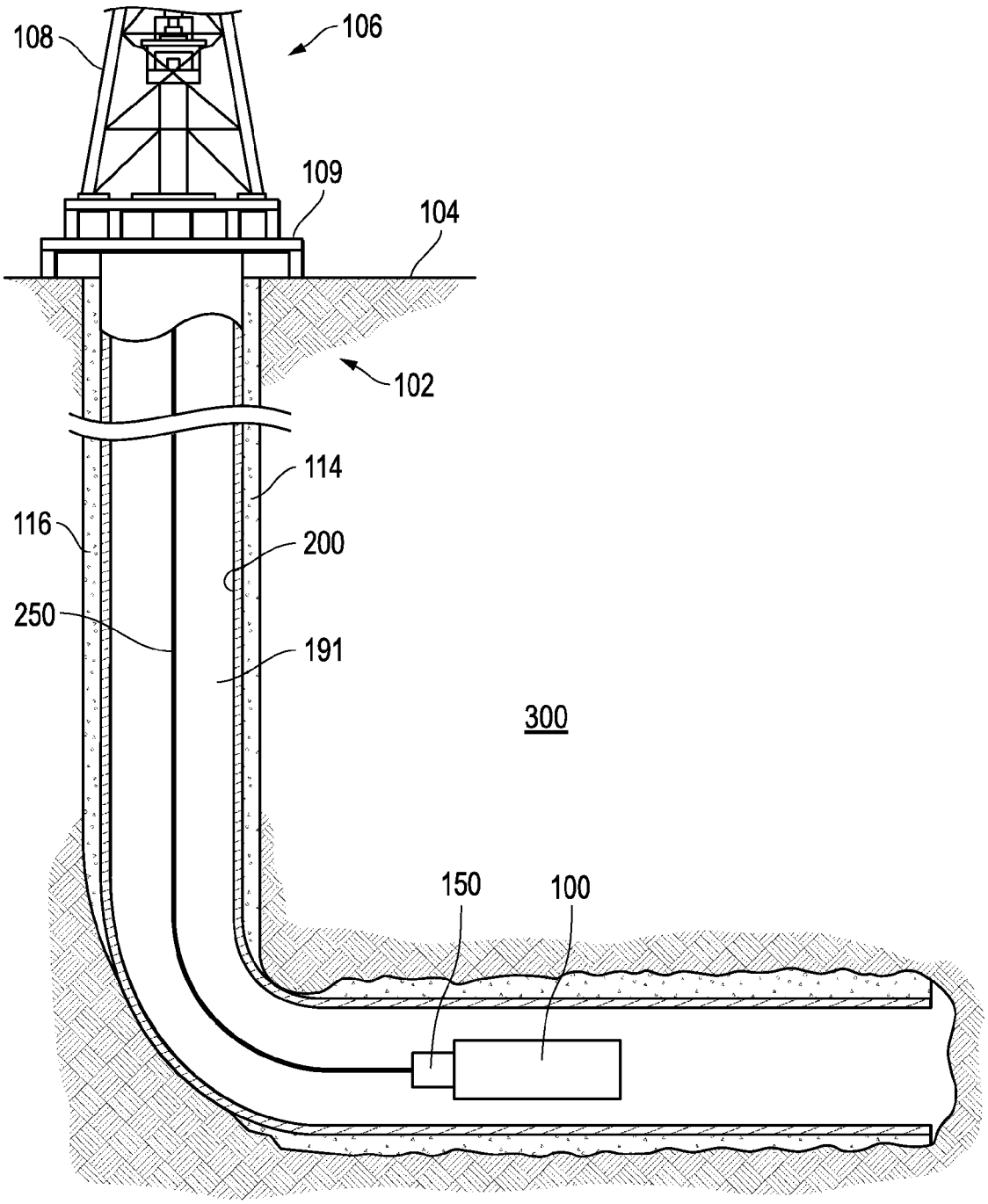
FIG. 1 is a partial cut-away view of an operating environment of a resettable packer assembly depicting a wellbore penetrating a subterranean formation and having a casing string positioned within the wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing tools (e.g., wellbore isolation tools), systems, and methods of using the same. Particularly, disclosed herein are one or more embodiments of a resettable, rotationally-set/unset packer assembly (RPA) and methods of using the same. Disclosed herein are one or more embodiments of the RPA which may be transitioned between a first or "unset" configuration/mode (e.g., run-in-hole mode) and a second or "set" configuration/mode (e.g., deployed, actuated mode), for example, in which the RPA is suitable for isolating two or more adjacent zones of a casing string from each other.

Referring to FIG. 1, an embodiment of an operating environment in which such a RPA may be employed is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1, the operating environment comprises a drilling or servicing rig 106 that is positioned on the earth's surface 104 and extends over and around a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 by any suitable drilling technique. In an embodiment, the drilling or servicing rig 106 comprises a derrick 108 with a rig floor 109 through which a tubular string (e.g., a casing string 200) generally defining an axial flowbore 191 may be positioned within the wellbore 114. The drilling or servicing rig 106 may be conventional and may comprise a motor driven winch and other associated equipment for lowering a tubular casing string (e.g., the casing string 200, a work string, etc.) into the wellbore 114, for example, so as to position the tubular string at the desired depth.

In an embodiment the wellbore 114 may extend substantially vertically away from the earth's surface 104 over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In an embodiment, a portion of the casing string 200 may be secured into position against the formation 102 in a conventional manner using cement 116. In alternative embodiment, the wellbore 114 may be partially completed (e.g., cased) and cemented thereby resulting in a portion of the wellbore 114 being uncemented.

In another embodiment, the casing string 200 may further comprise (e.g., have incorporated therein) one or more packers, for example, for the purpose of securing the casing string 200 within the wellbore 114 and/or isolating two or more production zones. The packer(s) may generally comprise a device or apparatus which is selectively configurable to seal or isolate two or more depths in a wellbore from each other by providing a barrier concentrically about a tubular string (e.g., the casing string 200) and an outer surface (e.g., a wellbore or casing wall). In an embodiment, the packer(s) may comprise a hydraulic (or hydraulically set) packer, a mechanical packer, a swellable packer (for example, Swell-Packers™, commercially available from Halliburton Energy Services), or combinations thereof.

While the operating environment depicted in FIG. 1 refers to a stationary drilling or servicing rig 106 for lowering and setting the casing string 200 within a land-based wellbore 114, one of ordinary skill in the art will readily appreciate that mobile workover rigs, wellbore completion units (e.g., coiled tubing units and/or wire-line units) may be similarly employed. Additionally, it should be understood that a RPA may be employed within other operational environments, such as within an offshore wellbore operational environment.

Figure 2:
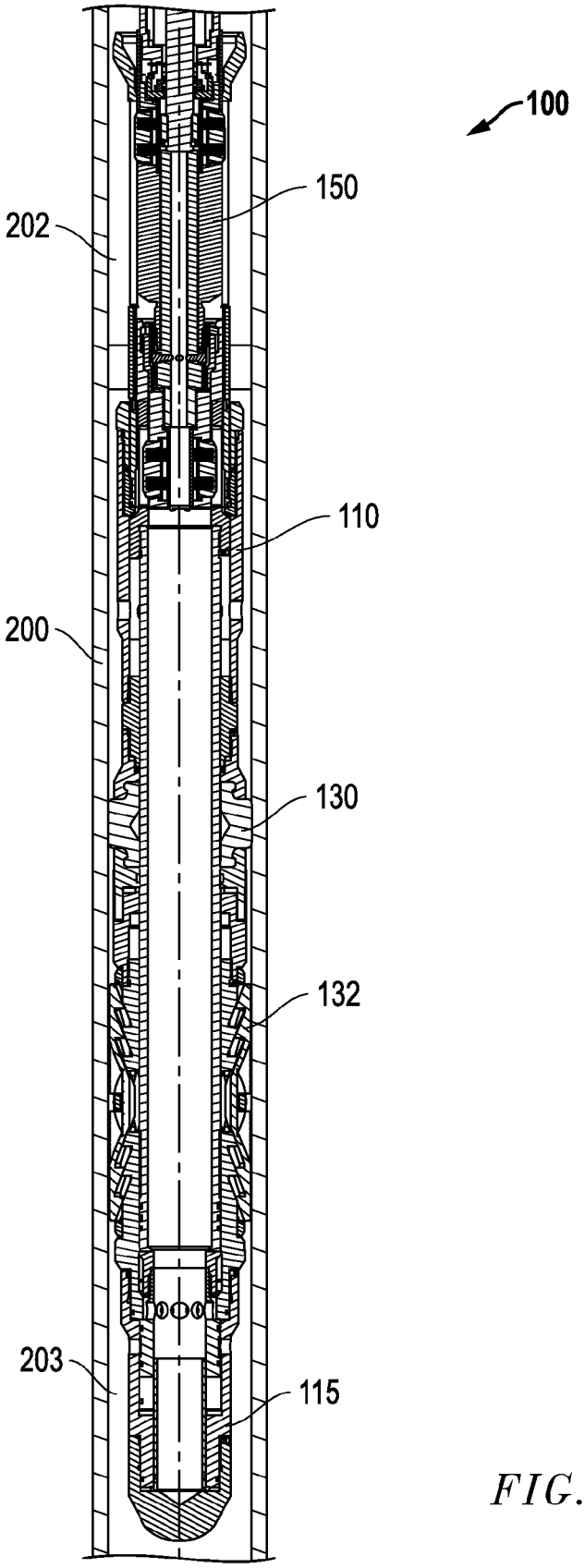
FIG. 2 is a close-up partial cutaway view of a wellbore servicing tool within a casing string.
Figure 3A:
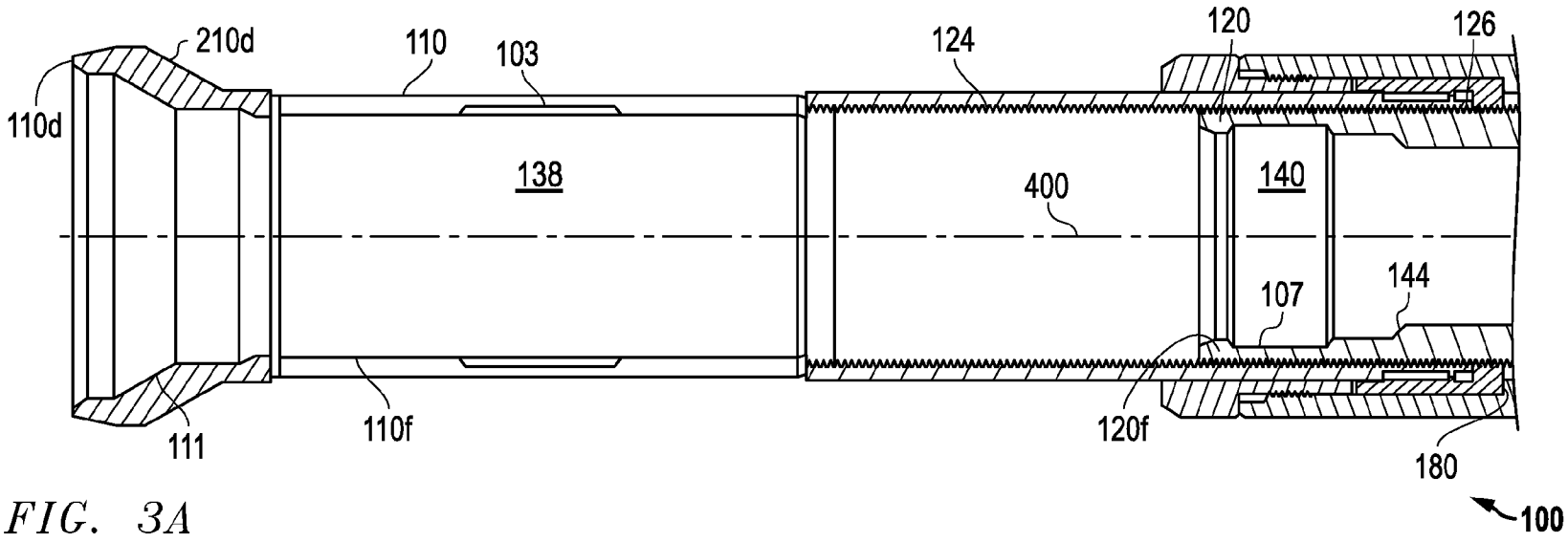
FIGS. 3A-3D are cross-sectional views of successive axial sections of an embodiment of a resettable, rotationally-set/unset packer assembly in a first configuration/mode.
Figure 3B:
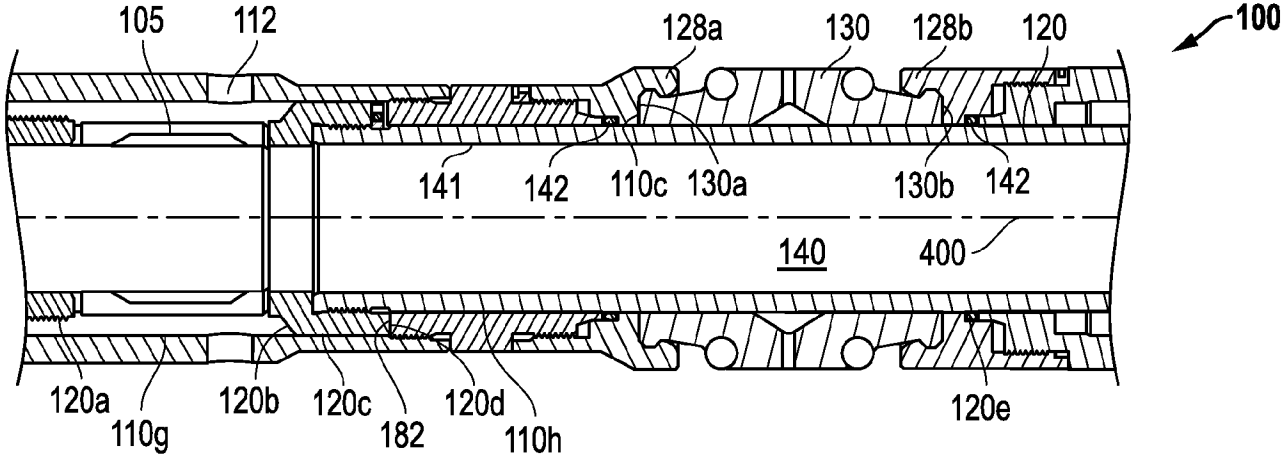
Figure 3C:
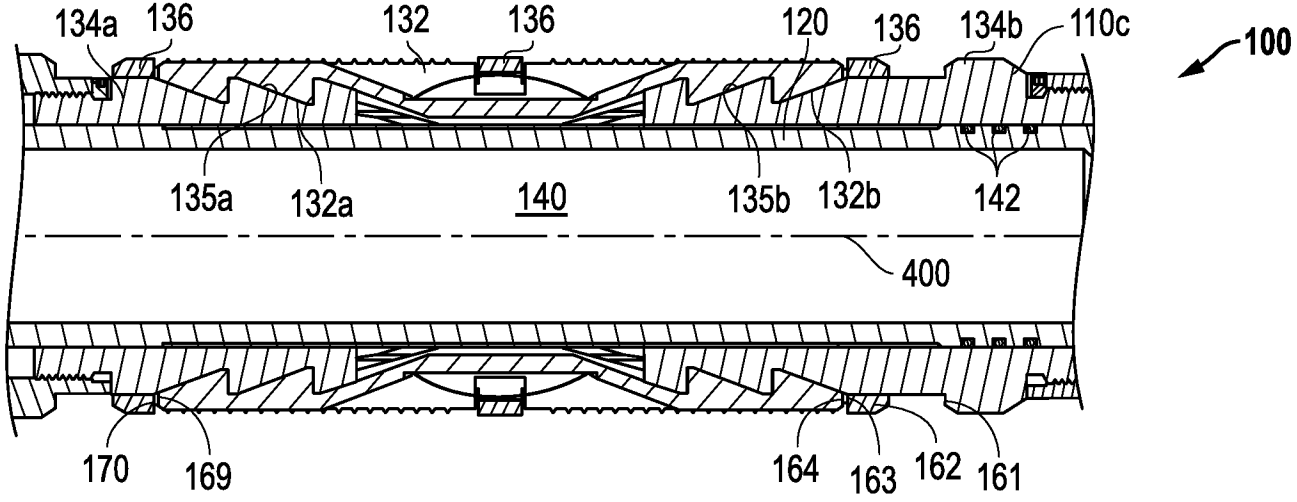
Figure 3D:
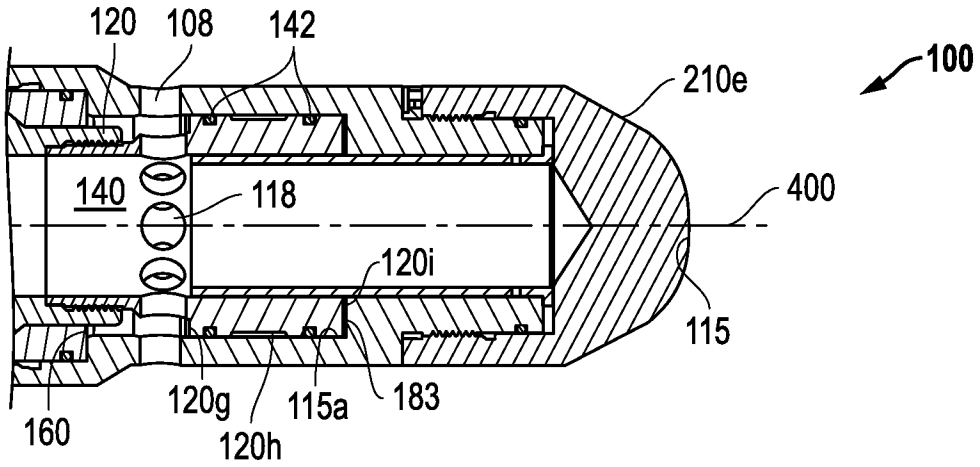
Figure 4A:
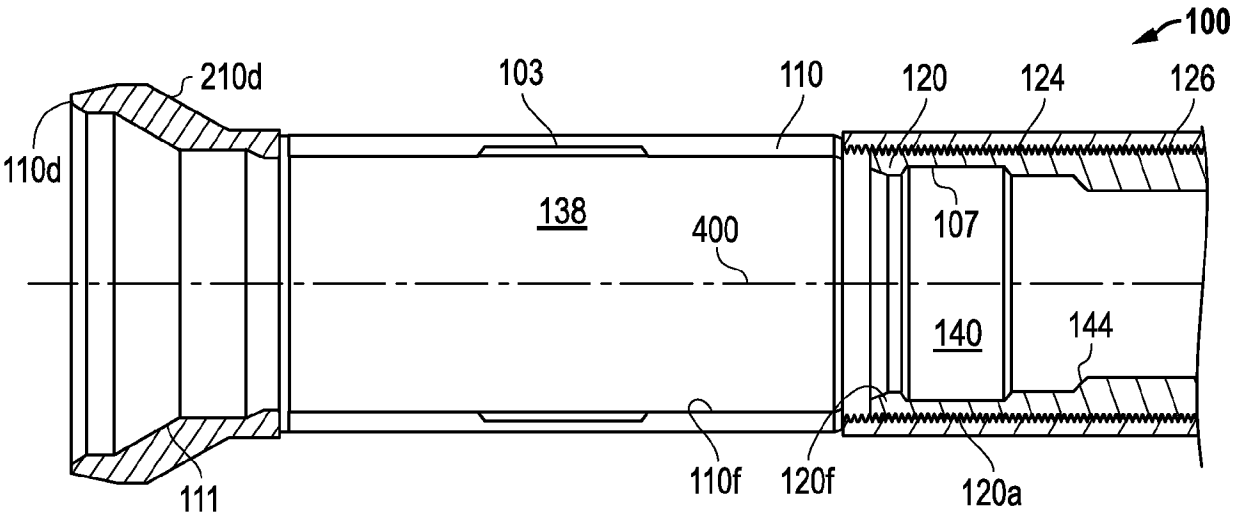
FIGS. 4A-4D are cross-sectional views of successive axial sections of an embodiment of a resettable, rotationally-set/unset packer assembly in a second configuration/mode.
Figure 4B:
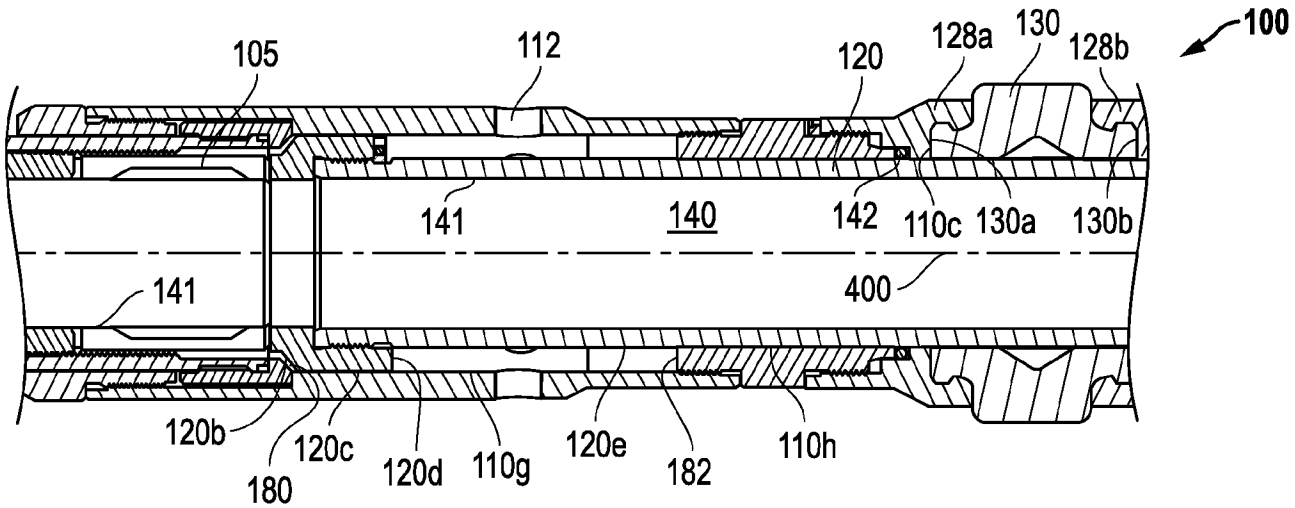
Figure 4C:
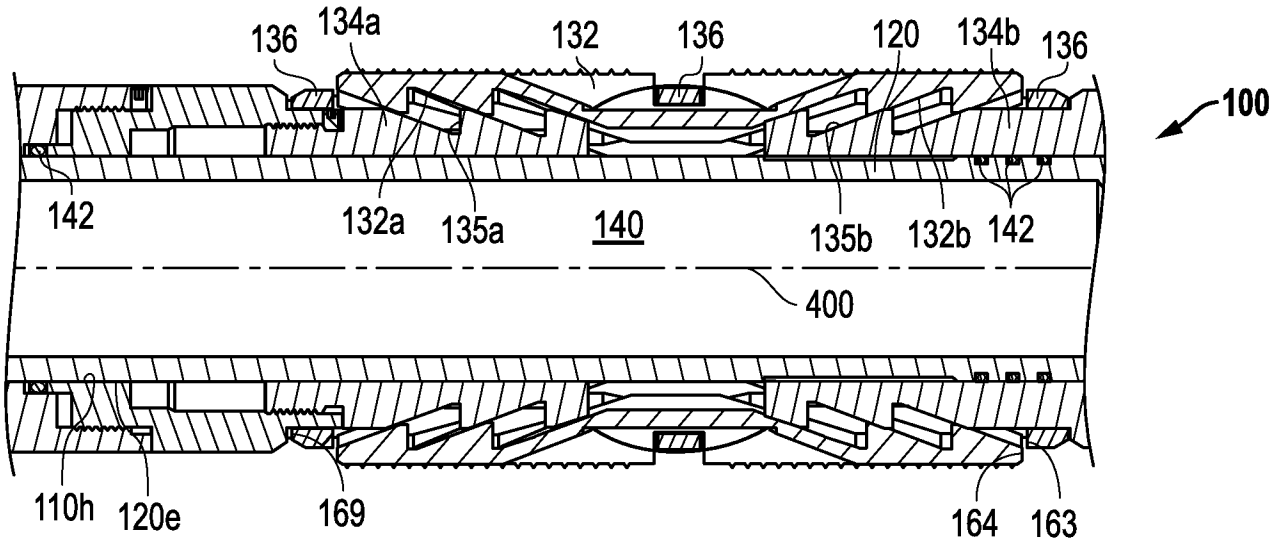
Figure 4D:
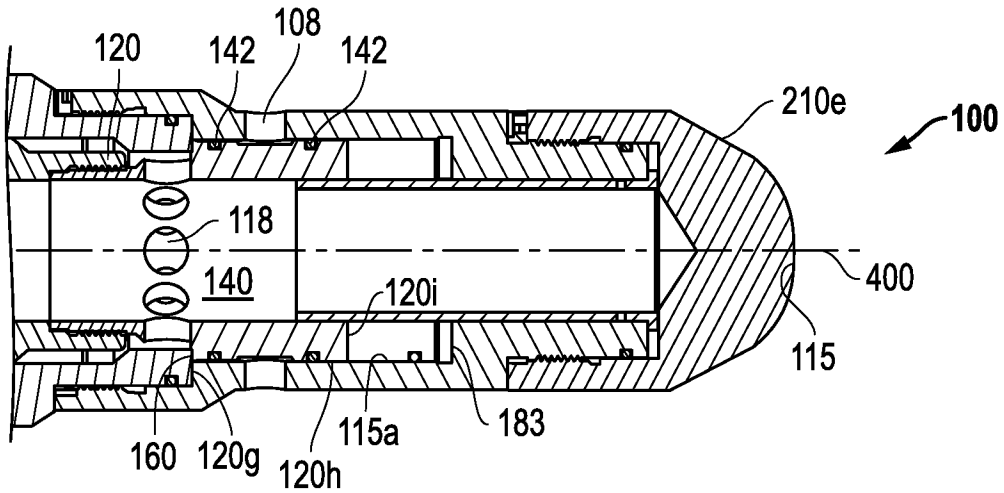

Referring to FIG. 1, a wellbore servicing system 300 is illustrated. In the embodiment of FIG. 1, the wellbore servicing system 300 comprises a RPA 100 releasably attached/coupled to a setting tool 150, which is attached/coupled to (e.g., in signal communication with) a wire-line 250 (e.g., one or more cables, slick-lines, data/signal conduits, or combinations thereof). In an embodiment, the wire-line 250 and the setting tool 150 may be configured to deliver the RPA 100 to a predetermined depth within the wellbore 114 and/or casing string 200. Referring to FIG. 2, in an embodiment, the RPA 100 may be deployed within the wellbore 114 and/or casing string 200 so as to isolate two or more portions or zones (e.g., adjacent zones) of the wellbore 114 and/or the casing string 200, as will be described in more detail later herein. It is noted that although the RPA 100 is disclosed as being integrated with a wire-line (e.g., wire-line 250), in alternative embodiments the RPA may be similarly suspended from a setting tool which is incorporated within a work string or other tubular sting (e.g., a coiled tubing string), for example, having a data or signal conduit therein. As such, this disclosure should not be construed as limited to any particular embodiment.

In an embodiment as will be disclosed herein, the RPA 100 may be configured to be selectively transitioned from a first or "unset" configuration/mode to a second or "set" configuration/mode (e.g., to be "set") and from the second or "set" configuration/mode to the first or "run-in" configuration/mode (e.g., to be "unset"), for example, while disposed within casing string 200. Particularly, and as will be disclosed herein, the RPA 100 may be configured to be set upon the application of a rotational force to the RPA 100 (e.g., so as to cause rotation of two or more components of the RPA 100 with respect to each other) in a first direction and to be unset upon the application of a rotational force to the RPA 100 (e.g., so as to cause rotation of the two or more components of the RPA 100 with respect to each of) in a second (e.g., opposite) direction.

Referring to FIGS. 3A-3D and 5A-5D, the RPA 100 is illustrated in the first configuration/mode. In an embodiment, when the RPA 100 is in the first configuration/mode, also referred to as a run-in or unset configuration/mode, the RPA 100 is configured to not forcibly engage an interior surface(s) of a casing string (e.g., the casing string 200) and does not provide isolation (e.g., fluid and/or pressure isolation) between two or more zones or portions of the axial flowbore of the casing string 200.

Referring to FIGS. 4A-4D and 6A-6D, the RPA 100 is illustrated in the second configuration/mode. In an embodiment, when the RPA 100 is configured in the second configuration/mode, also referred to as a set configuration, the RPA 100 is configured to forcibly engage the interior surface a casing string (e.g., the casing string 200) and to thereby provide isolation (e.g., fluid and/or pressure isolation) between two or more zones or portions of the axial flowbore of the casing string 200. For example, in the embodiment of FIG. 2, the RPA 100 may provide fluid and/or pressure isolation within the axial flowbore of the casing string 200 between a first zone 202 and a second zone 203. In an embodiment, and as will be disclosed herein, the RPA 100 may be configured to transition from the first configuration to the second configuration (e.g., to be set) upon the application of a rotational force (e.g., a clock-wise or counter clock-wise rotational force about a longitudinal axis 400) to an interior portion of the RPA 100 with respect to an outer portion of the RPA 100.

Additionally, the RPA 100 may be further configured to transition from the second configuration to the first configuration (e.g., to be unset) upon the application of a rotational force (e.g., a clock-wise or counter clock-wise rotational force about a longitudinal axis 400) to an interior portion of the RPA 100 with respect to an outer portion of the RPA 100 in the opposing direction as is required to transition the RPA 100 from the first configuration to the second configuration.

Referring to FIGS. 3A-3D, 4A-4D, 5A-5D, and 6A-6D, the RPA 100 generally comprises a mandrel 120 and a plurality of exterior elements (e.g., one or more housing components, one or more packer elements, one or more slips, etc.) disposed around an exterior surface of the mandrel 120 and located/arranged longitudinally along the mandrel 120, as will be disclosed herein. The RPA 100 may be characterized with respect to a central or longitudinal axis 400. Also, the RPA may be characterized with respect to a first terminal end 210*d* (e.g., an up-hole end) and/or a second terminal end 210*e* (e.g., a down-hole end), for example, as illustrated in FIGS. 3A-3D, 4A-4D, 5A-5D, and 6A-6D. While the embodiments of FIGS. 3A-3D, 4A-4D, 5A-5D, and 6A-6D, disclose an embodiment in which the various exterior elements are arranged in a particular order and/or number, one of ordinary skill in the art upon viewing this disclosure, will appreciate additional or alternative arrangements including one or more of such elements. As such, this disclosure should not be construed as limited solely to the configuration disclosed with respect to the figures herein.

Referring to the embodiment of FIGS. 3A-3D, 4A-4D, 5A-5D, and 6A-6D, the RPA 100 comprises a mandrel 120, an upper housing 110, one or more packer elements 130, one or more slips 132, and a lower housing 115.

Referring to the embodiments of FIGS. 3A-3D, 4A-4D, 5A-5D, and 6A-6D, the mandrel 120 generally comprises a cylindrical or tubular structure generally defining the axial flowbore 140 extending there-through. For example, in the embodiments of FIGS. 3A-3D, 4A-4D, 5A-5D, and 6A-6D, the mandrel 120 comprises a mandrel bore surface 141 generally defining the axial flowbore 140. In an embodiment, for example, in the embodiments of FIGS. 3A-3D, 4A-4D, 5A-5D, and 6A-6D, mandrel bore surface 141 comprises an inner seat 144 (e.g., a "no-go") comprising a shoulder or bevel, for example, generally configured to engage the setting tool 150 or a portion thereof. In an embodiment, the mandrel 120 may generally comprise multiple operably connected components; alternatively, the mandrel 120 may comprise a single, unitary component.

In an embodiment, the mandrel 120 may be configured such that one or more exterior elements (e.g., the upper housing 110, the packer element(s) 130, the slip(s) 132, the lower housing 115, or combinations thereof), may be slidably (e.g., rotationally and/or longitudinally) positioned about the mandrel 120. Additionally, in an embodiment the mandrel 120 may comprise a plurality of surfaces of various diameters and/or shoulders, for example, which may interact with one or more of the exterior elements. For example, in the embodiments of FIGS. 3A-3D, 4A-4D, 5A-5D, and 6A-6D, the mandrel 120 comprises a first upward facing mandrel shoulder 120*f*, a second upward facing mandrel shoulder 120*b*, a first outer cylindrical surface 120*a* extending between the first upward facing mandrel shoulder 120*f* and the second upward facing mandrel shoulder 120*b*, a first downward facing mandrel shoulder 120*d*, a second outer cylindrical surface 120*c* extending between the second upward facing mandrel shoulder 120*b* and the first downward facing mandrel shoulder 120*d*, a third upward facing mandrel shoulder 120*g*, a third outer cylindrical surface 120*e* extending between the first downward facing mandrel shoulder 120*d* and the third upward facing mandrel shoulder 120*g*, a second downward facing mandrel shoulder 120*i*, and a fourth outer cylindrical surface 120*h* extending between the third upward facing mandrel shoulder 120*g* and the second downward facing mandrel shoulder 120*i*.

Additionally, and as will be disclosed herein, the relative longitudinal and/or rotational position of one or more of the exterior elements (e.g., the upper housing 110, the packer element(s) 130, the slip(s) 132, the lower housing 115, or combinations thereof) with respect to the mandrel 120 may determine the configuration of the RPA 100, as will be disclosed herein.

In an embodiment, the mandrel 120 may be configured to engage the setting tool 150 or a portion thereof. For example, in an embodiment, the mandrel 120 comprises a mandrel-tool interface 105. In such embodiments, the mandrel-tool interface 105 may be positioned proximate to an up-hole portion of the mandrel 120 (e.g., between the first upward facing mandrel shoulder 120*f* and the second upward facing mandrel shoulder 120*b*). In an embodiment, the mandrel-tool interface 105 may be configured to engage and/or mate with the setting tool 150 (alternatively, a rotational tool, a down hole power unit, etc.), as will be disclosed herein, particularly, to engage and/or mate with one or more lugs, keys, radial extensions, or the like of the setting tool 150. For example, in an embodiment, the mandrel-tool interface 105 comprises one or more slots extending radially outward from the inner bore surface 141 of the mandrel, alternatively, one or more keys, grooves, notches, or any other suitable configurations as would be appreciated by one of ordinary skill in the art upon viewing this disclosure. Additionally, in an embodiment, the mandrel-tool interface 105 (e.g., one or more slots) may comprise a route of fluid communication between the axial flowbore 140 defined by the mandrel 120 and the exterior of the mandrel 120 (e.g., one or more exterior surfaces of the mandrel 120).

Additionally, in an embodiment, the mandrel 120 may be configured to be selectively coupled to/with the setting tool 150, as will be disclosed herein. For example, in an embodiment, the mandrel 120 further comprises a retainer profile 107. In such embodiments, the retainer profile may be positioned proximate to an up-hole portion of the mandrel 120 (e.g., between the first upward facing mandrel shoulder 120*f* and the second upward facing mandrel shoulder 120*b*). In an embodiment, the retainer profile 107 may comprise one or more grooves, slots, notches, or the like, and may be configured to engage the setting tool 150 or a component thereof (e.g., a retainer lug), as will be disclosed herein.

In an embodiment, the mandrel 120 may comprise one or more exterior, threaded interfaces, for example, for the purpose of imparting longitudinal movement between the mandrel 120 and one or more of the exterior elements (e.g., the upper housing 110, the packer element(s) 130, the slip(s) 132, the lower housing 115, or combinations thereof) upon the rotation between the mandrel 120 and one or more of such exterior elements. For example, in the embodiments of FIGS. 3A-3D, 4A-4D, 5A-5D, and 6A-6D, the first outer cylindrical surface 120*a* of the mandrel 120 comprises an exterior threaded interface 126 (e.g., a large stub acme thread), for example, which may be configured to engage and/or interact with a portion of the upper housing 110, as will be disclosed herein. In an embodiment, the exterior threaded interface 126 may comprise a clockwise (e.g., a "right-handed" or forward) thread; alternatively, the exterior threaded interface 126 may comprise a counter-clockwise (e.g., a "left-handed" or reverse) thread. The exterior threaded interface 126 may comprise a suitable lead (e.g., longitudinal travel per revolution), a suitable pitch (e.g., distance between thread crests), a suitable number of starts, and a suitable thread angle, as will be appreciated by one of skill in the art upon viewing this disclosure.

Additionally, in an embodiment, the mandrel 120 may further comprise one or more of ports (e.g., one or more bypass ports 118) extending radially outward from and/or inward towards the axial flowbore 140. For example, in the embodiments of FIGS. 3A-3D, 4A-4D, 5A-5D, and 6A-6D, the bypass ports 118 may be disposed radially about a down-hole portion of the mandrel 120. In such an embodiment, the bypass ports 118 may provide a route of fluid communication between the axial flowbore 140 and an exterior of the mandrel 120 and/or the RPA 100 when the RPA 100 is so-configured, as will be disclosed herein.

In an embodiment, the upper housing 110 may be characterized as a generally tubular body. The upper housing 110 may also be characterized as generally defining a longitudinal bore (e.g., an axial bore 138). In an embodiment, the upper housing 110 may generally comprise multiple operably connected components; alternatively, the upper housing 110 may comprise a single, unitary component. Additionally, in an embodiment, the upper housing 110 may have an outer or external profile having a plurality of different outer diameters, for example, at different longitudinal locations along the upper housing 110, i.e., across different portions of the upper housing 110. Alternatively, the upper housing 110 may comprise any suitable structure and/or outer profile as would be appreciated by one of ordinary skill in the art upon viewing this disclosure.

In the embodiments of FIGS. 3A-3D, 4A-4D, 5A-5D, and 6A-6D, the upper housing 110 may generally define a first bore surface 110*f* spanning between the first (e.g., upper) terminal end 110*d* and a first downward facing shoulder 180, a second bore surface 110*g* spanning between the first downward facing shoulder 180 and a first upward facing shoulder 182, and a third bore surface 110*h* spanning between the first upward facing shoulder 182 and a second (e.g., lower) terminal end 110*c*. Also, in an embodiment the upper housing 110 may generally define an outwardly-flared and/or conical surface 111 (e.g., a "fishing neck"), for example, generally disposed toward the first terminal end 110*d* of the upper housing 110.

In an embodiment, the upper housing 110 may configured to engage the setting tool 150 or a portion thereof. For example, in an embodiment the upper housing 110 (e.g., the first bore surface 110*f*) may comprise a housing-tool interface 103. In an embodiment, the first tool interface 103 may be configured to engage and/or mate with the setting tool 150 (alternatively, a rotational tool, a down hole power unit, etc.), as will be disclosed herein, particularly, to engage and/or mate with one or more lugs, keys, radial extensions, or the like of the setting tool 150. For example, in an embodiment, the housing-tool interface comprises one or more grooves, slots, notches, or any other suitable configuration as would be appreciated by one of ordinary skill in the art upon viewing this disclosure.

In an embodiment, the upper housing 110 may comprise one or more interior threaded interfaces, for example, for the purpose of imparting longitudinal movement between the mandrel 120 and the upper housing 110 upon rotation between the mandrel 120 and the upper housing 110. For example, in the embodiments of FIGS. 3A-3D, 4A-4D, 5A-5D, and 6A-6D, the first bore surface 110*f* comprises an interior threaded interface 124. In such an embodiment, the threaded interior interface 124 may comprise a threaded surface (e.g., large stub acme threads) and may be configured to engage and/or interact with a portion of the mandrel 120, particularly, the exterior threaded interface 126. For example, the exterior threaded interface 126 may be suitably configured so as to mate and/or interact with the exterior threaded interface, as disclosed herein. In an embodiment, the threaded interior interface 124 may be positioned downhole from (e.g., below) the first tool interface 103.

Additionally, in an embodiment, the upper housing 110 may further comprise one or more ports (e.g., bypass ports 112) extending radially outward from and/or inward towards the axial flowbore 138. For example, in the embodiments of FIGS. 3A-3D, 4A-4D, 5A-5D, and 6A-6D, the bypass ports 112 may be disposed radially about the upper housing 110. In such an embodiment, the bypass ports 112 may provide a route of fluid communication between the axial flowbore 138 and an exterior of the upper housing 110 when the RPA 100 is so-configured. For example, the RPA 100 may be configured such that the ports provide a route of fluid communication between the axial flowbore 140 and an exterior the RPA 100 when the RPA 100 is so-configured, for example, when the bypass ports 112 of the upper housing 110 are aligned with (e.g. in fluid communication with) the mandrel-tool interface 105 (e.g., slots) of the mandrel 120.

In an embodiment, the upper housing 110 may be slidably positioned about at least a portion of the mandrel 120. For example, in the embodiment of FIGS. 3A-3D, 4A-4D, 5A-5D, and 6A-6D, the first bore surface 110*f*, the second bore surface 110*g*, and the third bore surface 110*h* of the upper housing 110 may be movable (e.g., rotationally or longitudinally slidably) fitted against the first outer cylindrical surface 120*a*, the second outer cylindrical surface 120*c*, and the third outer cylindrical surface 120*e*, respectively, of the mandrel 120. In an embodiment, one or more of such interfaces may be fluid-tight and/or substantially fluid-tight. For example, in an embodiment, one or more of such interfaces between the mandrel 120 and the upper housing 110 may further comprise one or more suitable seals 142 (e.g., an O-ring, a T-seal, a gasket, etc.) disposed at such an interface, for example, for the purpose of prohibiting and/or restricting fluid movement via such that interface. Additionally, in an embodiment, the upper housing 110 may be positioned about the mandrel 120 such that the interior threaded interface 124 of the upper housing 110 mates, engages, and/or interacts with the exterior threaded interface 126 of the mandrel 120, for example, such that the relative rotation of the upper housing 110 with respect to the mandrel 120 causes the upper housing 110 to move longitudinally relative to the mandrel 120, as will be disclosed herein.

In an embodiment, the RPA 100 comprises an upper extrusion limiter 128*a*. For example, in the embodiments of FIGS. 3A-3D, 4A-4D, 5A-5D, and 6A-6D, the upper housing 110 comprises the upper extrusion limiter 128*a* incorporated therein. The upper extrusion limiter 128*a* may generally be configured to provide a relatively upper spatial limit, for example, so as to prevent the packer element 130 or a portion thereof from moving (e.g., extruding) upwardly past the upper extrusion limiter 128*a*. For example, when the RPA 100 is set (e.g., upon actuation of the RPA 100, as will be described later herein), the upper extrusion limiter 128*a* may prevent at least a portion of the packer element 130 from upward movement relative to and past the upper extrusion limiter 128*a*. In the embodiments of FIGS. 3A-3D, 4A-4D, 5A-5D, and 6A-6D, the upper extrusion limiter 128*a* is incorporated within the upper housing 110; alternatively, an upper extrusion limiter may comprise a separate component and may be slidably positioned about at least a portion of the mandrel 120. Suitable types and/or configurations of extrusions limiters will be appreciated by one of skill in the art upon viewing this disclosure.

In the embodiments of FIGS. 3A-3D, 4A-4D, 5A-5D, and 6A-6D, the RPA 100 comprises one or more packer elements 130 disposed about the mandrel 120 and adjacent to the upper housing 110, particularly, adjacent to and/or abutting the upper extrusion limiter 128*a*. In the embodiment of FIGS. 3A-3D, 4A-4D, 5A-5D, and 6A-6D, the RPA 100 comprises a single packer element 130. In alternative embodiments, the RPA 100 may comprise any suitable number and/or arrangement of packer elements, for example, 2, 3, 4, 5, 6, or more packer elements like packer element 130. In an embodiment, the one or more packer elements 130 may be configured to exhibit a radial expansion (e.g., an increase in exterior diameter) upon being subjected to an axial compression (e.g., a force compressing the packer elements in a direction generally parallel to the longitudinal axis 400). For example, each of the one or more packer elements 130 may comprise (e.g., be formed from) a suitable material, such as an elastomeric compound and/or multiple elastomeric compounds. Examples of suitable elastomeric compounds include, but are not limited to nitrile butadiene rubber (NBR), hydrogenated nitrile butadiene rubber (HNBR), ethylene propylene diene monomer (EPDM), fluoroelastomers (FKM) [for example, commercially available as Viton®], perfluoroelastomers (FFKM) [for example, commercially available as Kalrez®, Chemraz®, and Zalak®], fluoropolymer elastomers [for example, commercially available as Viton®], polytetrafluoroethylene, copolymer of tetrafluoroethylene and propylene (FEPM) [for example, commercially available as Aflas®], and polyetheretherketone (PEEK), polyetherketone (PEK), polyimide-imide (PAI), polyimide [for example, commercially available as Vespel®], polyphenylene sulfide (PPS) [for example, commercially available as Ryton®], and any combination thereof. For example, instead of Aflas®, a fluoroelastomer, such as Viton® available from DuPont, may be used for the packer elements 130. Not intending to be bound by theory, the use of a fluoroelastomer may allow for increased extrusion resistance and a greater resistance to acidic and/or basic fluids. In an embodiment, the packer elements 130 may be constructed of a single layer; alternatively, the packer elements 130 may be constructed of multiple layers (e.g., plies), for example, with each layer or ply comprise either the same, alternatively, different elastomeric compounds. In an embodiment, the packer element 130 may be configured to transition from an unset configuration to a set configuration, for example, so as to sealingly engage an interior surface of a casing string (e.g., the casing string 200). Referring to FIGS. 3A-3D and 5A-5D, the RPA 100 is shown in an unset mode/position in which the packer element 130 is radially unexpanded, for example, prior to actuation of the RPA 100. Referring to FIGS. 4A-4D and 6A-6D, the RPA 100 is shown in a set mode/position in which the packer element 130 is radially expanded. In the embodiments of FIGS. 3A-3D, 4A-4D, 5A-5D, and 6A-6D, the packer element 130 may generally comprise an upper contact surface 130*a* and a lower contact surface 130*b*. In an embodiment, the upper contact surface 130*a* and the lower contact surface 130*b* of the packer element 130 are each about perpendicular to the longitudinal axis 400 of the RPA 100; alternatively, the upper contact surface 130*a* and/or the lower contact surface 130*b* may deviate from perpendicular to the longitudinal axis 400, either in the upward/up-hole direction (i.e., deviates upwardly) or in the downward/down-hole direction (i.e., deviates downwardly), by an angle less than about 20°, alternatively less than about 15°, 10°, 9°, 8°, 7°, 6°, 5°, 4°, 3°, 2°, or 1°, based on angle degrees. Not intending to be bound by theory, an angle degree may be defined as $1/360^{th}$ of a full circle rotation, based on a full circle having 360°.

In an embodiment, the RPA 100 also comprises a lower extrusion limiter 128*b*. For example, in the embodiments of FIGS. 3A-3D, 4A-4D, 5A-5D, and 6A-6D, the lower extrusion limiter is generally configured provide a relatively lower spatial limit, for example, so as to prevent the packer element 130 or a portion thereof from moving (e.g., extruding) downwardly past the lower extrusion limiter 128*b*. For example, when the RPA 100 is set (e.g., upon actuation of the RPA 100, as will be described later herein), the lower extrusion limiter 128*b* may prevent at least a portion of the packer element 130 from downward movement relative to the and past the lower extrusion limiter 128*b*. Referring to FIGS. 3A-3D, 4A-4D, 5A-5D, and 6A-6D, the lower extrusion limiter 128*b* is located adjacent to, below, and/or abutting the packer element 130.

In the embodiments of FIGS. 3A-3D, 4A-4D, 5A-5D, and 6A-6D, the RPA 100 comprises an upper slip wedge 134*a* slidably positioned about the mandrel 120. In an embodiment, the upper slip wedge 134*a* may comprise a plurality of contact surfaces (e.g., an upper wedge contact surface 135*a*). For example, the upper wedge contact surfaces 135*a* of the upper slip wedge 134*a* may comprise a plurality of sloped contact surfaces (e.g., ramps) each forming an acute angle (e.g., an angle less than 90°) with respect to the longitudinal axis 400 and extending outwardly in the upward/up-hole direction. In an embodiment, the acute angles of the upper wedge contact surfaces 135*a* of the upper slip wedge 134*a* may be from about 25° to 60°, alternatively, from about 30° to about 50°, alternatively, from about 35° to 45°, alternatively, any suitable range as would be appreciated by one of ordinary skill in the art upon viewing this disclosure. In an embodiment, the upper slip wedge 134*a* may comprise a separate, unitary component, for example, which may be slidably positioned about the mandrel 120 adjacent to, abutting, and/or positioned downward relative to the lower extrusion limiter 128*b*. In an alternative embodiment, the lower extrusion limiter 128*b* and the upper slip wedge 134*a* may comprise a single, unitary component.

In the embodiments of FIGS. 3A-3D, 4A-4D, 5A-5D, and 6A-6D, the RPA 100 also comprises a lower slip wedge 134*b* slidably positioned about the mandrel 120. In the embodiments of FIGS. 3A-3D, 4A-4D, 5A-5D, and 6A-6D, the lower slip wedge 134*b* may comprise a plurality of sloped contact surfaces (e.g., a lower wedge contact surfaces 135*b*). For example, the lower wedge contact surfaces 135*b* of the lower slip wedge 134*b* may comprise a plurality of sloped contact surfaces (e.g., ramps) each forming an acute angle (e.g., an angle less than 90°) with respect to the longitudinal axis 400 and extending outwardly in the downward/down-hole direction. In an embodiment, the lower wedge contact surfaces 135*b* of the lower slip wedge 134*b* may comprise a plurality of sloped contact surfaces each forming an acute angle (e.g., an angle less than 90°) with respect to the longitudinal axis 400 and extending in the downward/down-hole direction. In an embodiment, the acute angles of the lower wedge contact surfaces 135*b* of the lower slip wedge 134*b* may be from about 25° to 60°, alternatively, from about 30° to about 50°, alternatively, from about 35° to 45°, alternatively, any suitable range as would be appreciated by one of ordinary skill in the art upon viewing this disclosure.

In the embodiments of FIGS. 3A-3D, 4A-4D, 5A-5D, and 6A-6D, the RPA 100 comprises a plurality of slip segments 132 having an up-hole slip shoulder 169 and a down-hole slip shoulder 164 and generally disposed around and/or circumferentially about the upper slip wedge 134*a* and the lower slip wedge 134*b*, for example, so as to engage and/or interact with the plurality of sloped surfaces of the upper slip wedge 134*a* and the lower slip wedge 134*b*. As will be appreciated by one of ordinary skill in the art upon viewing this disclosure, any suitable number of slip segments may be used, for example, 2, 3, 4, 5, 6, 7, 8, 9, 10, 11, 12, 13, 14, 15, 16, or more segments. Each of the slip segments 132 may comprise a radial portion of a cylinder which may further comprise a plurality of inner inclined surfaces (e.g., a radial portion of a truncated canonical or "trunconical" surface), for example, slip inclined surfaces 132*a* and 132*b*. The inclined surfaces 132*a* and 132*b* may contact/interact with the upper slip wedge 134*a* and the lower slip wedge 134*b*, such that movement of the upper slip wedge 134*a* and/or the lower slip wedge 134*b* in the direction of the slip segments 132 (e.g., a down-hole movement of the upper slip wedge 134*a* and/or up-hole movement of the lower slip wedge 134*b*) may cause the slip segments 132 to expand radially outward, for example, from a retracted position to an expanded position such that the slip segments 132 may engage the casing string 200 and yield a full 360° (alternatively, substantially 360°) grip on the casing string 200, as will be disclosed herein. In an embodiment, the slip segments 132 may be configured to grip and/or engage one or more surfaces of the casing string 200. For example, an outer surface of the slip segments 132 may optionally further comprise features such as teeth, lugs, and/or protrusions, for example, to enable/facilitate the interaction between the slip segments 132 and the casing string 200.

Figure 7:
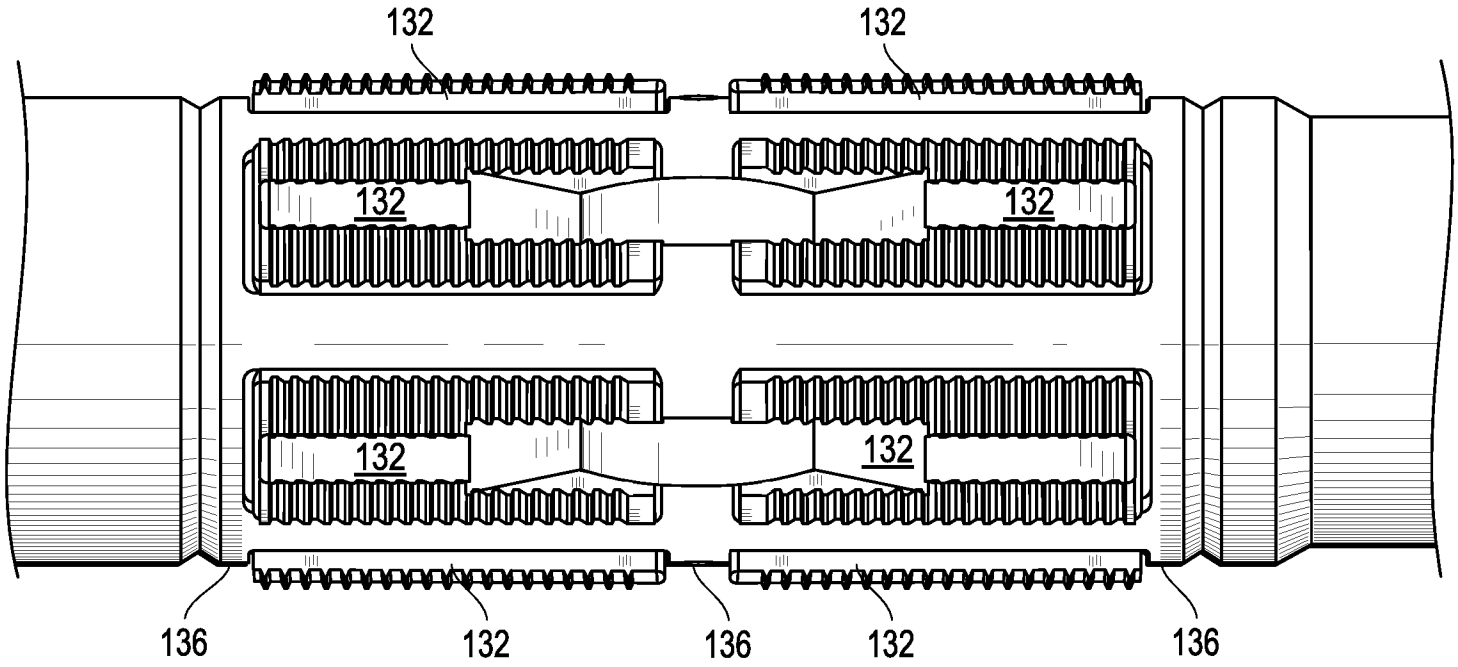
FIG. 7 is a side view of a portion of an embodiment of a resettable, rotationally-set/unset packer assembly.

In the embodiments of FIGS. 3A-3D, 4A-4D, 5A-5D, and 6A-6D, the RPA 100 may further comprises a slip retainer 136 generally configured to retain the plurality of slip segments 132 with respect to the mandrel, for example, to allow the slip segments 132 to radially expand and/or contract with respect to the mandrel 120 while still retaining the slip segments 132 about the mandrel 120. Referring to FIG. 7, an embodiment of the slip retainer 136 is illustrated. In the embodiment of FIG. 7, as well as the embodiments of FIGS. 3A-3D, 4A-4D, 5A-5D, and 6A-6D, the slip retainer 136 generally comprises a housing-like member comprising a plurality of slots, for example, one or more slots for each of the plurality of slip segments 132. As shown in the embodiment of FIGS. 3A-3D, 4A-4D, 5A-5D, 6A-6D, and 7 the slip segments 132 are each disposed within slots within the slip retainer 136, for example, thereby allowing the slip segments 132 to be generally retained about the mandrel 120 while also being radially expandable and/or contractible. Additionally, in an embodiment one or more of the slip segments 132 may be radially, inwardly biased, for example, such that the slip segments 132 will exhibit a tendency to contract radially inward unless forced radially outward, for example, via an interaction with the upper slip wedge 134*a* and the lower slip wedge 134*b*, as disclosed herein. In an additional or alternative embodiment, the slip retainer may comprise one or more retaining bands generally positioned around the slip segments 132 and configured so as to radially retain the slip segments 132 circumferentially about the mandrel 120. In an embodiment, the lower retaining band(s) may also allow for the radial expansion/movement of the slip segments 132, for example, by stretching, expanding, or the like, when the RPA 100 transitions into the second or set configuration/mode, as will be disclosed herein. In an embodiment, the retaining band(s) may comprise an elastomeric material, a metal material (e.g., steel wire), a plastic material, or a composite material, or combinations thereof, having the requisite characteristics, for example, exhibiting sufficient strength to hold the slip segments 132 and exhibiting sufficient properties of expansion.

In an embodiment, the lower housing 115 may be characterized as a generally tubular body, for example, a bullet-nosed cone or guide-shoe like structure. The lower housing 115 may also be characterized as generally defining a longitudinal bore. In an embodiment, the lower housing 115 may generally comprise multiple operably coupled components; alternatively, the lower housing 115 may comprise a single, unitary component. Also, in the embodiment of FIGS. 3A-3D, 4A-4D, 5A-5D, and 6A-6D, the lower housing 115 is incorporated with the lower slip wedge 134*b*, thereby forming a single, unitary component.

In an embodiment, the lower housing 115 may generally define a fourth bore surface 115*a* spanning between a downward facing shoulder 160 and an upward facing shoulder 183. In an embodiment, the lower housing 115 and the lower slip wedge 134*b* may comprise separate, independent components, for example, the lower housing 115 being adjacent to, abutting, and/or positioned downward relative to the lower slip wedge 134*b*.

In an embodiment, the lower housing 115 comprises one or more bypass ports (e.g., bypass ports 108) extending radially outward from and/or inward through the lower housing. For example, in the embodiments of FIGS. 3A-3D, 4A-4D, 5A-5D, and 6A-6D, the bypass ports 108 may be disposed radially about the lower housing 115. In such an embodiment, the bypass ports 108 may provide a route of fluid communication between the axial flowbore 140 of the mandrel 120 and the exterior of the lower housing 115 when the RPA 100 is so-configured. For example, the RPA 100 may be configured such that the ports provide a route of fluid communication between the axial flowbore 140 and an exterior the RPA 100 when the RPA 100 is so-configured, for example, when the bypass ports 108 of the lower housing 115 are aligned with (e.g., in fluid communication with) the bypass ports 118 of the mandrel 120.

In the embodiment of FIGS. 5A-5D and 6A-6D, the RPA 100 is illustrated releasably and selectively coupled with a setting tool 150, for example, for the purposes of positioning the RPA 100 and/or to actuate the RPA 100 (e.g., to transition the RPA 100 between the first configuration/mode and the second configuration/mode). In an embodiment, as illustrated in FIGS. 5A-5D and 6A-6D, the setting tool 150 comprises a housing-engaging member 152 and a mandrel-engaging member 153. In such an embodiment, the housing-engaging member 152 may be suitably sized and/or configured to engage the housing-tool interface 103 of the RPA 100 and the mandrel-engaging member 153 may be suitably sized and/or configured to engage the mandrel-tool interface 105 of the RPA 100. In an embodiment, each of the housing-engaging member 152 and the mandrel-engaging member 153 may be configured to impart torque (e.g., rotational force) to the upper housing 110 (e.g., via engagement with the housing-tool interface 103) and to the mandrel 120 (e.g., via engagement with the mandrel-tool interface 105). For example, in the embodiment of FIGS. 5A-5D and 6A-6D, the housing-engaging member 152 and the mandrel-engaging member 153 may each comprise an outwardly-biased (e.g., spring-loaded) torque key, lug, pin, extendable member, or the like.

In an embodiment, the setting tool 150 may be configured to impart rotation of the housing-engaging member 152 with respect to the mandrel-engaging member 153. For example, in an embodiment, the setting tool 150 may be selectively configurable to cause the housing-engaging member 152 to rotate clockwise with respect to the mandrel-engaging member 153 and/or to rotate counter-clockwise with respect to the mandrel-engaging member 153, for example, about and/or with respect to the longitudinal axis 400. In an embodiment, the setting tool may comprise one or more motors, for example, to supply the rotational force. Also, in an embodiment, the setting tool 150 may derive power from a source external to the wellbore, for example, via a wireline or other power conduit. Alternatively, the setting tool 150 may comprise an on-board power source (e.g., a battery and/or a power generation device).

Figure 5A:
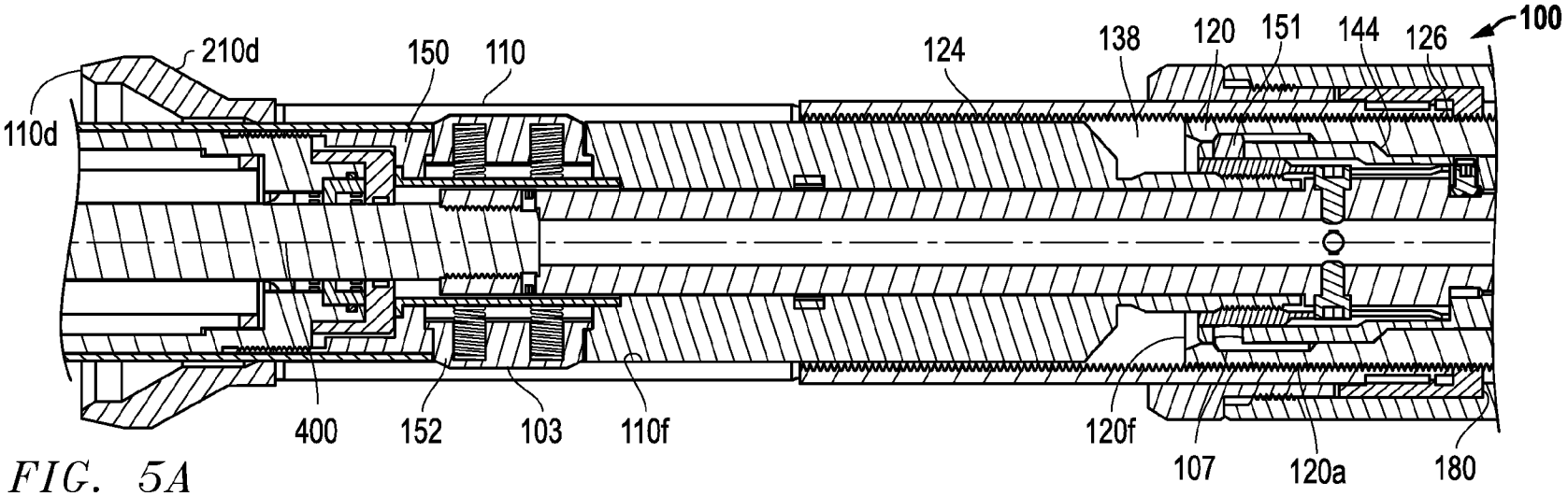
FIGS. 5A-5D are cross-sectional views of successive axial sections of an embodiment of a resettable, rotationally-set/unset packer assembly in a first configuration/mode and a setting tool.
Figure 5B:
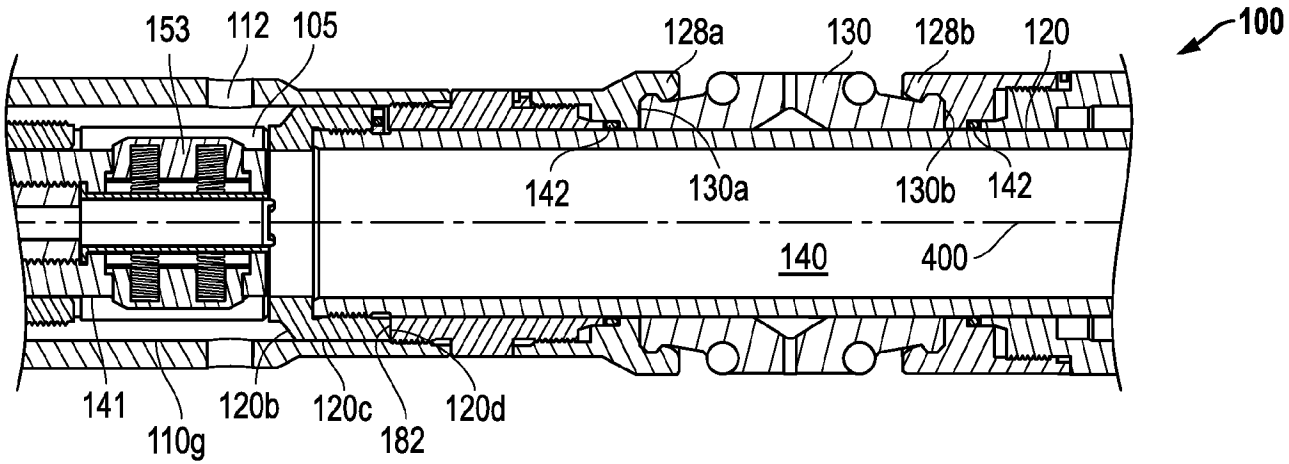
Figure 5C:
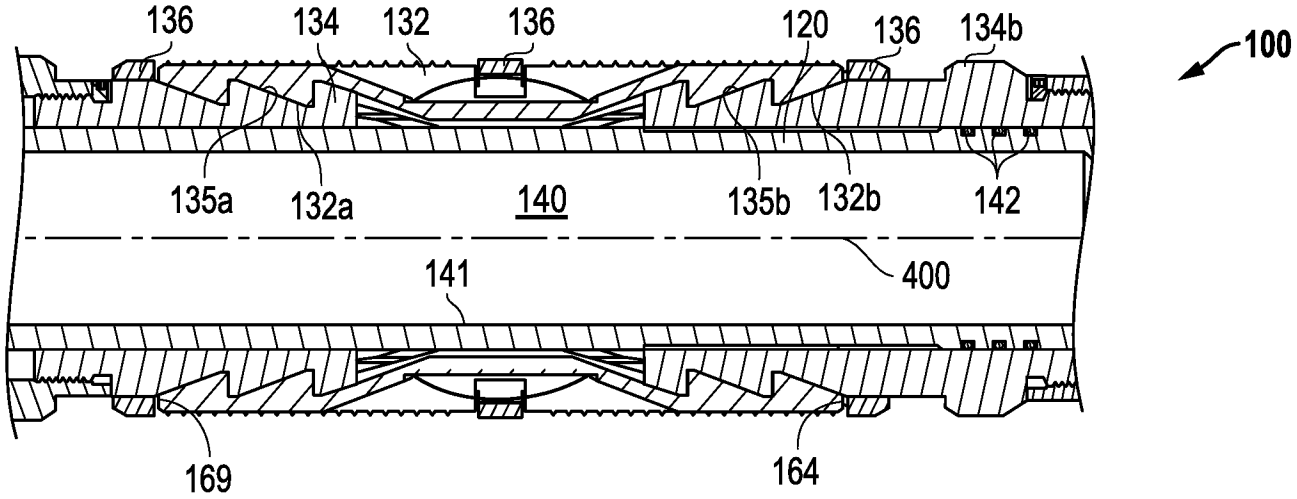
Figure 5D:
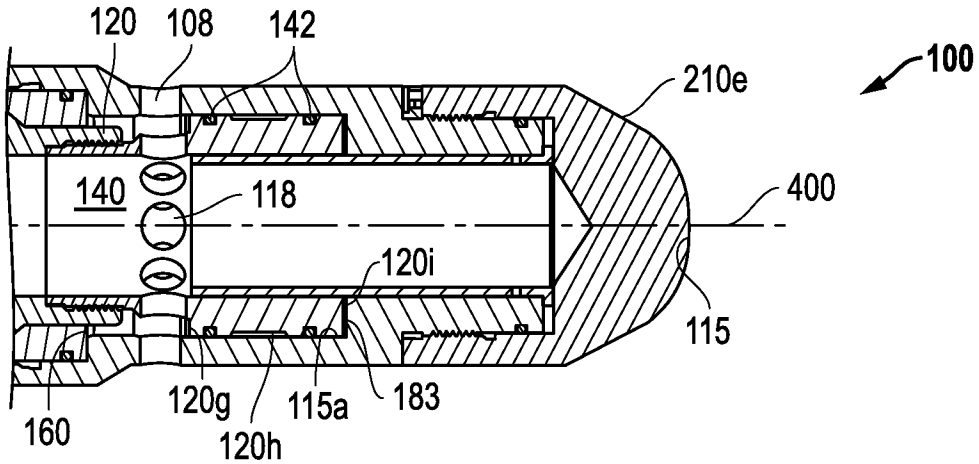
Figure 6A:
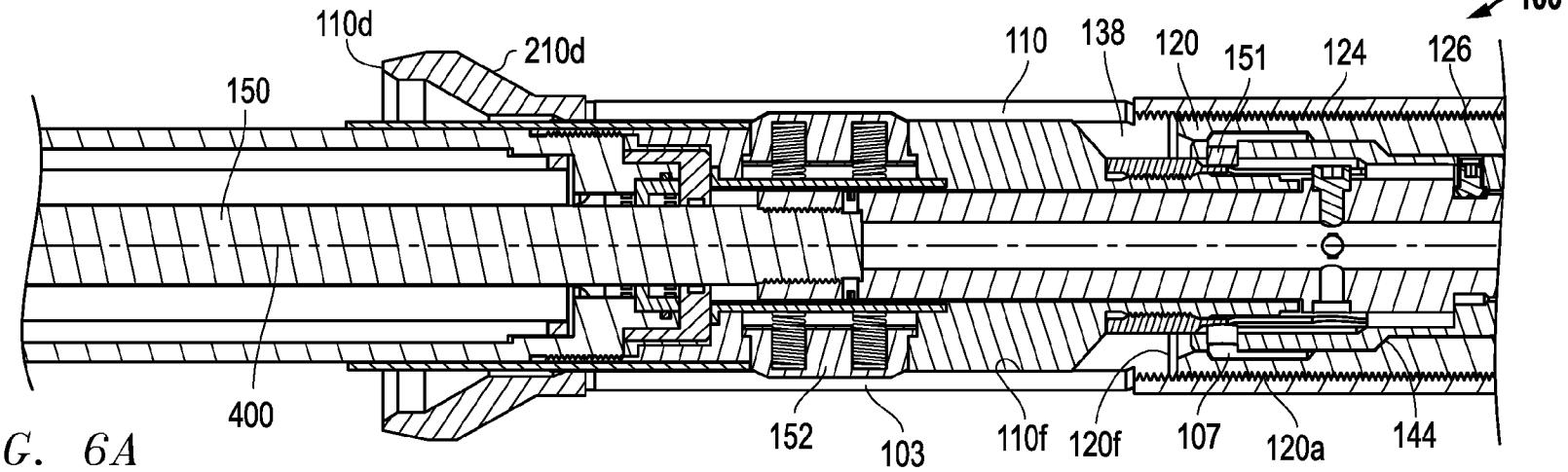
FIGS. 6A-6D are cross-sectional views of successive axial sections of an embodiment of a resettable, rotationally-set/unset packer assembly in a second configuration/mode and a setting tool.
Figure 6B:
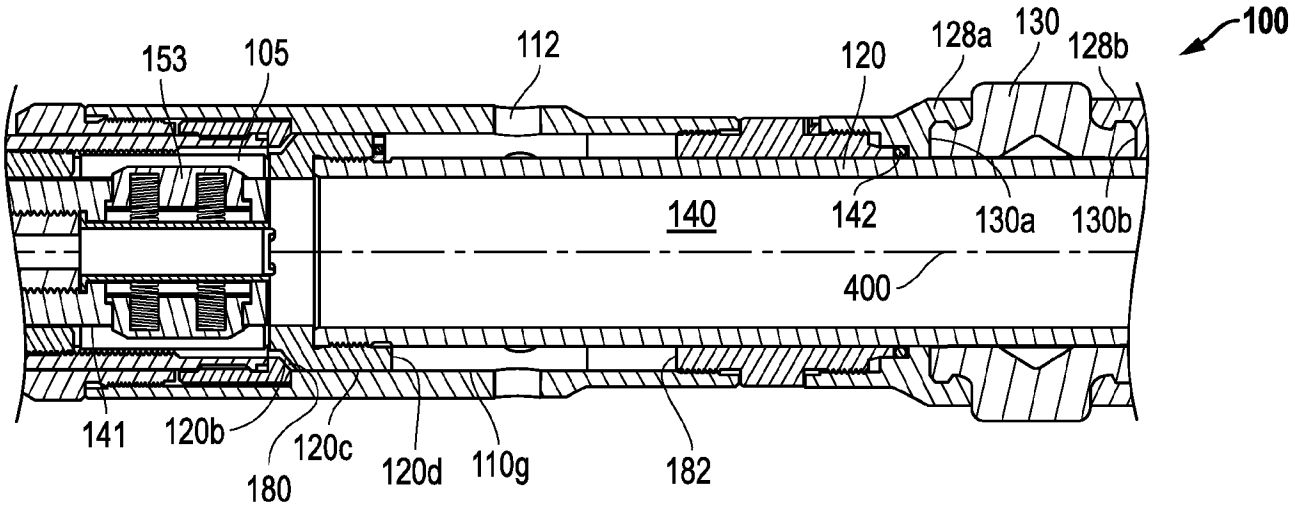
Figure 6C:
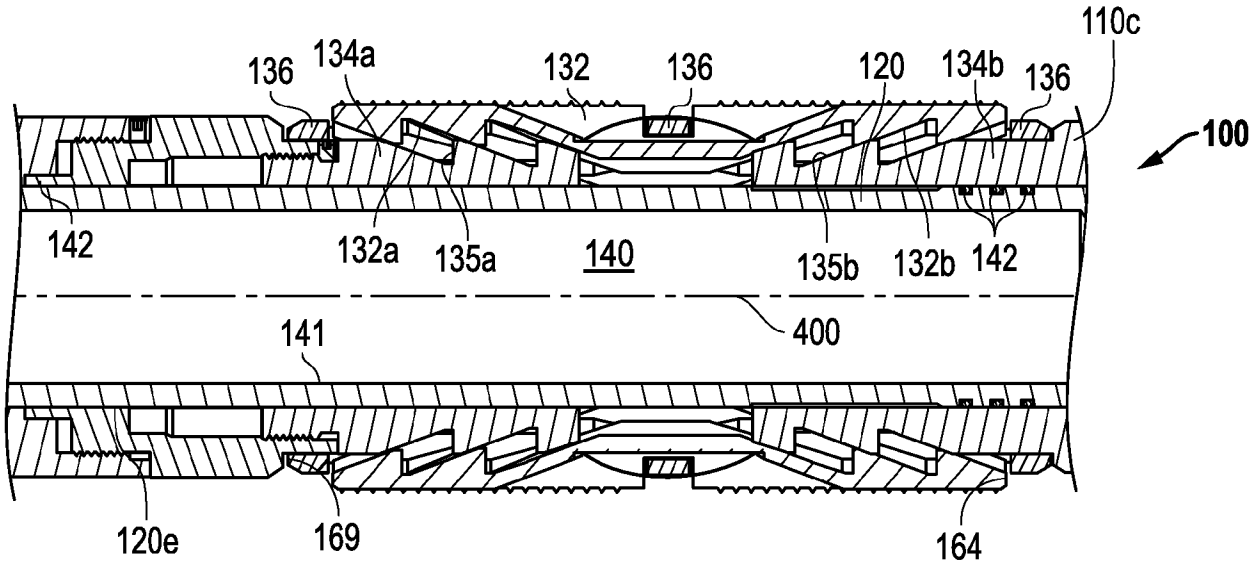
Figure 6D:
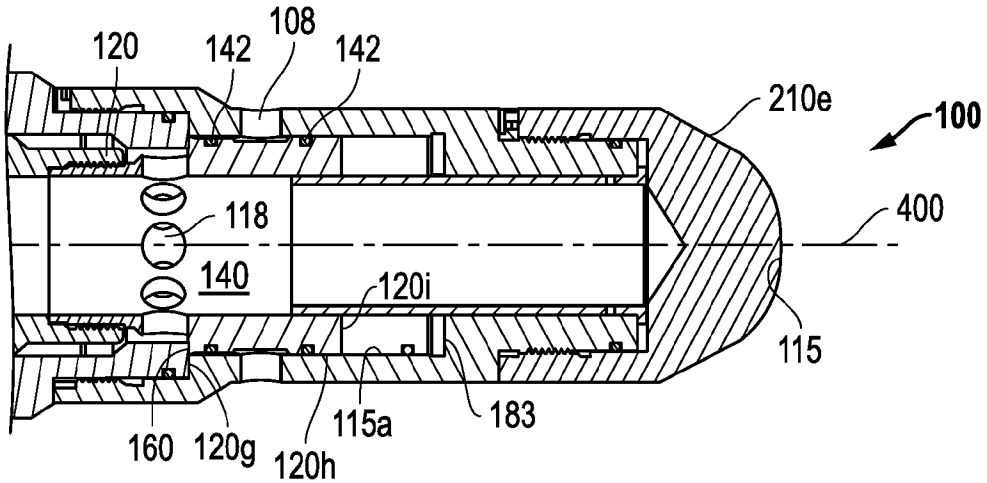

Additionally, in an embodiment, the setting tool 150 may be configured to be selectively coupled to the RPA 100. For example, in the embodiments of FIGS. 5A-5D and 6A-6D, the setting tool 150 further comprise one or more retainer lugs 151. In an embodiment, the retainer lugs 151 may be selectively radially expandable (e.g., so as to engage the RPA 100) and selectively radially retractable (e.g., so as to disengaged the RPA 100). For example, when radially expanded, the retainer lugs 151 may be configured so as to engage the retainer profile 107 within the mandrel 120, thereby locking the setting tool 150 with respect to the RPA 100 (e.g., as shown in FIG. 5A). Also, when radially retracted, the retainer lugs 151 may be configured so as to disengage the retainer profile 107 within the mandrel 120, thereby unlocking the setting tool 150 from the RPA 100. In an embodiment, the setting tool 150 may be configured such that the retainer lugs 151 extend radially outward upon actuation of the tool (e.g., in the direction so as to unset the tool, as will be disclosed herein) and such that the retainer lugs 151 retract radially inward upon actuation of the tool (e.g., in the direction so as to set the tool, as will also be disclosed herein).

One or more embodiments of an RPA (e.g., such as RPA 100) and/or a wellbore servicing system (e.g., such as wellbore servicing system 300) comprising such an RPA 100 having been disclosed, one or more embodiments of a wellbore servicing method employing such a wellbore servicing system 300 and/or such a RPA 100 are also disclosed herein. In an embodiment, a wellbore servicing method may generally comprise the steps of positioning a setting tool (e.g., such as setting tool 150) coupled to a RPA 100 within a wellbore, actuating the setting tool 150 to set the RPA 100, removing the setting tool 150, performing a wellbore servicing operation, reintroducing the setting tool 150 to the RPA 100, actuating the setting tool 150 to unset the RPA. In an embodiment, the wellbore servicing method may further comprise the steps of repositioning the setting tool 150 and the RPA 100, actuating the setting tool 150 to set the RPA 100, removing the setting tool 150, performing a wellbore servicing operation, reintroducing the setting tool 150 to the RPA 100, actuating the setting tool 150 to unset the RPA, for example, such that the different intervals/zones of a wellbore may be treated via successive unsetting, repositioning, and resetting of the RPA 100.

As will be disclosed herein, the RPA 100 may be effective to control fluid and/or pressure isolation during a wellbore servicing operation (e.g., a pressure testing operation or other operation). For example, as will be disclosed herein, following the step of actuating the setting tool 150 to set the RPA 100, the RPA 100 may be configured to provide fluid and/or pressure isolation between two or more zones or portions (e.g., a first zone 202 and a second zone 203) of the axial flowbore 191 of the casing string 200. Also, for example, during the step of actuating the setting tool 150 to unset the RPA 100, the RPA 100 may be configured to allow fluid and/or pressure communication between two or more zones or portions (e.g., the first zone 202 and the second zone 203) of the axial flowbore 191 of the casing string 200.

In an embodiment, the setting tool 150 and RPA 100 may be positioned (e.g., run in hole, lowered into, flowed into, etc.) within a wellbore, such as wellbore 114, for example, within a casing string, such as casing string 200, or a tubing string, for example, production tubing, as disclosed herein. Also, in an embodiment, the RPA 100 may be positioned within the wellbore 114 (e.g., within the casing string 200) in an unset configuration. In an embodiment, the setting tool 150 and RPA 100 may be positioned within the wellbore by downwardly communicating a fluid into the wellbore 114 (circulating a fluid through the wellbore 114) such that the RPA 100 is carried along with the moving fluid. In an embodiment, the RPA 100 may be positioned within the wellbore 114 coupled and/or connected to the setting tool 150, as will be disclosed herein. Also, in the embodiment of FIG. 1, the setting tool 150 may be coupled and/or connected to the wire-line 250. For example, in the embodiment of FIG. 1, the wire-line 250 may be connected to the setting tool 150 such that the wire-line 250 is operable to communicate power and/or an actuating signal (e.g., an electrical signal) to the setting tool 150 and/or to manipulate the position of the setting tool 150 and/or of the RPA 100 while in the wellbore. Also in an embodiment, the RPA 100 may be positioned within the wellbore 114 (e.g., by communicating a fluid and/or pulling on the wire-line 250) such that the RPA 100 is positioned so as to isolate two or more zones (e.g., generally between the two zones). Additionally, in an embodiment the setting tool 150 may be actuated via the operation of a timer.

Particularly, in an embodiment, the setting tool 150 and RPA 100 may be run into the wellbore 114 and/or casing string 200 with the RPA 100 configured in the first configuration/mode, for example, in which the packer elements 130 are uncompressed and are not expanded, and the slip segments 132 are retracted. In such an embodiment, with the RPA 100 configured in the first configuration/mode, the RPA 100 does not provide fluid and/or pressure isolation within the axial flowbore 191 of the casing string 200. Additionally, in such an embodiment, the RPA 100 may be configured such that fluid may be communicated between the exterior of the RPA 100 and the axial flowbore 140 of the RPA 100. For example, when unset, the bypass ports 112 of the upper housing 110 are aligned with the mandrel-tool interface 105 (e.g., slots) of the mandrel 120 and the bypass ports 108 of the lower housing 115 are aligned with the bypass ports 118 of the mandrel 120. For example, in an embodiment, a fluid within the axial flowbore 191 of the casing string 200 may be allowed to communicate via the bypass ports of the RPA 100, and thereby reduces the accumulation of down-hole pressure/resistance while positioning the setting tool 100 and the RPA 100.

In an embodiment, after positioning the RPA 100 and setting tool 150, the setting tool 150 may be actuated so as to set the RPA 100, for example, so as to transition the RPA 100 from the first configuration/mode to the second configuration/mode. For example, in an embodiment, with the setting tool 150 coupled to the RPA 100, the mandrel-engaging member 153 of the setting tool 150 may be engaged with the mandrel-tool interface 105 of the mandrel 102 and the and the housing-engaging member 152 of the setting tool 150 may be engaged with the housing-tool interface 103. In an embodiment, actuation of the setting tool 150 causes the mandrel-engaging member 153 to rotate (e.g., either clockwise or counter-clockwise, about the longitudinal axis 400) with respect to the housing-engaging member 152, for example, thereby imparting rotation to the upper housing 110 and/or the mandrel 120 with respect to each other, about the longitudinal axis 400.

In an embodiment, as the mandrel 120 and the upper housing 110 move with respect to each other, the threaded interfaces 124 and 126 interact, causing the upper housing 110 to move longitudinally down the mandrel 120 and/or the mandrel 120 to move longitudinally upward with respect to the upper housing 110. In such an embodiment, as the longitudinal movement between the mandrel 120 and the upper housing 110 continues, the elements surrounding the mandrel 120 are generally compressed with respect to the mandrel 120, for example, causing the mandrel 120 to move upward with respect to the lower housing 115. As the mandrel 120 moves with respect to the lower housing 115, the bypass ports 108 of the lower housing 115 become misaligned with the bypass ports 118 of the mandrel 120, thereby blocking the route of fluid communication. Also, as the mandrel 120 moves with respect to the lower housing 115, the third upward facing mandrel shoulder 120*g* of the mandrel 120 may come into contact with and/or abut the second downward facing shoulder 160 of the lower housing 150.

In an embodiment, upon the third upward facing mandrel shoulder 120*g* of the mandrel 120 coming into contact and/or abutment with the second downward facing shoulder 160 of the lower housing 150, and as the mandrel 120 and the upper housing 110 continue to move with respect to each other, the mandrel 120 may apply a force onto the lower housing 115 (e.g., via the engagement of the third upward facing mandrel shoulder 120*g* of the mandrel 120 and the downward facing shoulder 160 of the lower housing 115), causing the upper housing 110 and the lower housing 115 to move longitudinally closer to one another along the mandrel 120.

Also, in an embodiment, movement of the upper housing 110 with respect to the mandrel 120 may cause the bypass ports 112 of the upper housing 110 to become misaligned with the mandrel-tool interface 105 (e.g., slots) of the mandrel 120, thereby blocking the route of fluid communication.

In an embodiment, continued actuation of the setting tool 150, thereby shortening the longitudinal distance between the upper housing 110 and the lower housing 115, may cause the exterior elements (e.g., the one or more housing components, one or more packer elements, one or more slips, etc.) disposed around an exterior surface of the mandrel 120 to be compressed, for example, via the abutment between such elements. For example, the in an embodiment, the upper slip wedge 134*a* and the lower slip wedge 134*b* may apply a radially outward force onto the slip 132, for example, via an interaction between the lower wedge contact surface 135*b* of the lower slip wedge 134*b* and the inclined slip surface 132*b* of the slip 132 and via an interaction between the inclined slip surface 132*a* of the slip 132 and the upper wedge contact surface 135*a* of the upper wedge 134*a*, thereby causing the slip 132 to transition towards the expanded position.

Also, in an embodiment, the continued actuation of the of the setting tool 150 may cause a longitudinally compressive force to be applied to the packer element 130, for example, via the upper extrusion limiter 128*a* and the lower extrusion limiter 128*b*. In such an embodiment, the force (e.g., compressive force) may be sufficient to cause the packer element 130 to expand radially outward, for example, so as to compressingly engage an inner surface of the casing string 200 and/or a wellbore wall.

In an embodiment, the setting tool 150 may be actuated (e.g., rotating the mandrel-engaging member 153 with respect to the housing-engaging member 152) until the RPA 100 is set, for example, when the RPA 100 transitions to its second configuration/mode, thereby sealingly engaging the casing string 200. For example, in the embodiment of FIG. 2, the RPA 100 may provide fluid and/or pressure isolation within the axial flowbore of the casing string 200 between a first zone 202 and a second zone 203. In an embodiment, the RPA 100 may remain in the second configuration/mode until actuated by the setting tool 150 to transition the RPA 100 to the first configuration/mode.

In an embodiment, upon setting the RPA 100 (e.g., transitioning the RPA 100 to the second configuration/mode), the setting tool 150 may cease actuation (e.g., no longer rotate the mandrel-engaging member 153 with respect the longitudinal axis 400). For example, the setting tool 150 may comprise a switch or shut-off; alternatively, the operator may note an increase in the force/power necessary to continue to actuate the setting tool 150, indicating that the RPA has been set (e.g., transitioned to the second configuration/mode). Additionally, upon transitioning the RPA 100 to the second configuration/mode, the retainer lugs 151 of the setting tool 150 may retract radially inward, for example, such that the retainer lugs 151 disengage the retainer profile 107 of the mandrel 120, thereby unlocking the setting tool 150 from the RPA 100. In an embodiment, with the setting tool 150 decoupled from the RPA 100, the setting tool 150 may be removed, for example, by retracting the wire-line 250 toward the surface while the RPA 100 remains set within the wellbore. In an embodiment, the setting tool 150 may be removed from the casing string 200 (e.g., from the wellbore 114).

In an embodiment, one or more wellbore servicing operations may be performed with respect to the wellbore 114 and/or the subterranean formation penetrated by the wellbore 114. For example, in an embodiment, a hydraulic fluid pressure may be applied within the casing string 200 by pumping a fluid into the casing string 200, for example, via one or more pumps typically located at the surface, such that the pressure within the casing string 200 reaches an upper threshold. In an embodiment, such an application of pressure to the casing string 200 may comprise performing a pressure test. For example, during the performance of such a pressure test, a pressure, for example, of at least an upper magnitude, may be applied to the casing string 200 for a given duration. Such a pressure test may be employed to assess the integrity of the casing string 200 and/or components incorporated therein. Alternatively, any suitable wellbore servicing operation may be performed as would be appreciated by one of ordinary skill in the art upon viewing this disclosure. For example, in such an embodiment, a servicing fluid (e.g., a fracturing fluid, perforating fluid, acidizing fluid, or the like) may be introduced into the subterranean formation or a portion thereof at a rate and/or pressure sufficient to initiate and/or extend a fracture or other flowpath therein.

In an embodiment, the setting tool 150 (e.g., suspended from the wire-line 250) may be reintroduced into the production tubing or casing string 200, for example, upon the completion of one or more wellbore servicing operations (e.g., a pressure test). In an embodiment, the setting tool 150 is run into the axial flowbore 191 of the casing string 200, for example, as previously disclosed. In such an embodiment, the setting tool 150 may be positioned such that the setting tool 150 engages the RPA 100, for example, such that at least a portion of the setting tool 150 engages and stops against the inner seat 144 of the mandrel 120 (e.g., the no-go). For example (e.g., when the setting tool 150 or a portion thereof has engaged the inner seat 144 of the mandrel 120), in an embodiment, the housing-engaging member 152 (e.g., lugs) may be aligned with and engage the housing-tool interface 103 of the RPA 100 and the mandrel-engaging member 153 (e.g., lugs) may be aligned with and engage the mandrel-tool interface 105 of the RPA 100. Additionally, in such an embodiment, the retainer lug 151 of the setting tool 150 may be aligned with the retainer profile, but may remain radially retracted, such that the retainer lug 151 does not engaged the retainer profile 107 so as to couple the setting tool 150 and the RPA 100.

In an embodiment, after reintroducing the setting tool 150 and positioning the setting tool 150 with respect to the RPA 100, the setting tool 150 may be actuated to unset the RPA 100, for example, so as to transition the RPA 100 from the second configuration/mode to the first configuration/mode. For example, in an embodiment, with the setting tool 150 positioned with respect to the RPA 100, for example, where the mandrel-engaging member 153 of the setting tool 150 is engaged with the mandrel-tool interface 105 of the mandrel 102, actuation of the setting tool 150 causes the mandrel-engaging member 153 to rotate (e.g., either clockwise or counter-clockwise, about the longitudinal axis 400) with respect to the housing-engaging member 152 (e.g., in the opposite rotational direct used to set the RPA 100), thereby imparting rotation to the upper housing 110 and/or the mandrel 120 with respect to each other, about the longitudinal axis 400. In an embodiment, the mandrel 120 rotates with respect to the upper housing 110 causing the upper housing 110 to move longitudinally with respect to the mandrel 120 via the interaction of the threaded interfaces 124 and 126.

In an embodiment, as the mandrel 120 moves with respect to the upper housing 110 (e.g., in the opposite direction as disclosed with respect to setting the RPA 100) the upper housing 110 and the lower housing 115 move away from each other, allowing the elements surrounding the mandrel 120 become uncompressed. As the upper housing 110 and the lower housing 115 move in opposing directions, the lower housing 115 (e.g., downward facing shoulder 160 of the lower housing 115) ceases to engage the mandrel 120 (e.g., the third upward facing shoulder **120*g* of the mandrel 120), allowing bypass ports 108 of the lower housing 115 to become aligned with the bypass ports 118 of the mandrel 120, thereby providing a route of fluid communication between the exterior of the RPA 100 and the axial flowbore 140 of the RPA 100. Also, in an embodiment, as the mandrel 120 continues to move with respect to the upper housing 110, the bypass ports 112 of the upper housing 110 may become aligned with the mandrel-tool interface 105 (e.g., slots) of the mandrel 120, thereby providing a route of fluid communication between the exterior of the RPA 100 and the axial flowbore 140 of the RPA 100**.

Additionally, in an embodiment, as the upper housing 110 and the lower housing 115 move in opposing directions, for example, in response to the absence of a longitudinally compressive force being applied by the upper housing 110 and the lower housing 115, the packer element 130 may retract inwardly (e.g., transition from being radially to radially retracted), for example to the unset configuration. Also, the slip segments 132 may retract inwardly (e.g., transition from being radially expanded to radially retracted), for example, as the upper slip wedge **134*a* and the lower slip wedge 134*b* move in opposing directions, for example, thereby transitioning the RPA 100** from being set (e.g., the second configuration/mode) to unset (e.g., the first configuration/mode).

In an embodiment, upon transitioning the RPA 100 to the first configuration/mode, the setting tool 150 may cease actuation (e.g., no longer rotate the mandrel-engaging member 153 with respect the housing engaging member 152 about the longitudinal axis 400). For example, the setting tool 150 and/or the RPA 100 may be configured to rotate a certain number of turns to effectuate setting and/or unsetting. Alternatively, upon the RPA 100 reaching a particular (e.g., set or unset) configuration, the setting tool 150 may communicate a torque or current signal such that the operator may determine the configuration of the RPA 100. Additionally, upon transitioning the RPA 100 to the first configuration/mode, the retainer lug 151 of the setting tool 150 may expand radially outward and may engage the retainer profile 107, thereby coupling the setting tool 150 and the RPA 100. In an embodiment, the setting tool 150 and RPA 100 may be repositioned within the wellbore 114 (e.g., within the casing 200) and one or more of the steps of the wellbore servicing method disclosed herein repeated; alternatively, the setting tool 150 and RPA may be removed, for example, the wire-lie may be retracted toward the surface and/or removed from the casing string 200.

In an embodiment, a wellbore servicing tool such as the RPA 100, a wellbore servicing system such as wellbore servicing system 300 comprising a wellbore servicing tool such as the RPA 100, a wellbore servicing method employing such a wellbore servicing system 300 and/or such a RPA 100, or combinations thereof may be advantageously employed in the performance of a wellbore servicing operation. For example, as disclosed herein, a wellbore servicing tool such as RPA 100 may allow an operator to selectively provide isolation between two or more zones of a wellbore and/or of a subterranean formation and/or to selectively remove isolation between two or more zones of a wellbore and/or of a subterranean formation. For example, an operator may be able to set and/or unset RPA 100 thereby allowing the operator to reposition the RPA 100 as needed, for example, for isolating various portions of a casing string at different times depending on the wellbore servicing operation being performed. Additionally, an RPA like RPA 100 may be reused to quickly and efficiently provide and remove wellbore/zonal isolation without necessarily removing the RPA 100 from the wellbore. For example, the RPA 100 may be set and unset multiple times without the necessity to be removed from the wellbore 114 between each use (e.g., between unsetting and resetting) and, as such, may be useful for isolating multiple zones within a wellbore, for example, for the purpose of performing a multi-stage stimulation treatment. For example, because the RPA 100 does not require the use of shear pins or like assemblages, there is no need to "redress" the RPA 100 before a subsequent use. As such, the RPA 100 may be operated in a wellbore servicing operation as disclosed herein with improved speed and efficient in comparison to conventional servicing tools. Additional advantages of the RPA 100 and methods of using same may be apparent to one of skill in the art viewing this disclosure.

ADDITIONAL DISCLOSURE

The following are nonlimiting, specific embodiments in accordance with the present disclosure:

A first embodiment, which is a wellbore servicing tool comprising:

a mandrel generally defining an axial flowbore and an outer cylindrical surface, at least a portion of the outer cylindrical surface comprising a threaded exterior surface;

an upper housing generally defining a first inner cylindrical surface, at least a portion of the first inner cylindrical surface comprising a threaded interior surface, wherein the upper housing is movably positioned about at least a portion of the mandrel such that the threaded exterior surface at least partially engages the threaded interior surface;

a packer element exhibiting radial expansion upon being longitudinally compressed, wherein the packer element is movably positioned about at least a portion of the mandrel generally downward relative to the upper housing; and a lower housing generally defining a second inner cylindrical surface, wherein the lower housing is movably positioned about at least a portion of the mandrel, wherein the wellbore servicing tool is selectively transitionable from an unset configuration to a set configuration upon a decrease in longitudinal distance between the upper housing and the lower housing along the mandrel, wherein the wellbore isolation tool is selectively transitionable from the set configuration to the unset configuration upon an increase in longitudinal distance between the upper housing and the lower housing, and wherein the rotation of the upper housing with respect to the mandrel decreases the longitudinal distance between the upper housing and the lower housing along the mandrel or increases longitudinal distance between the upper housing and the lower housing along the mandrel.

A second embodiment, which is the wellbore servicing tool of the first embodiment, further comprising a plurality of slip segments disposed about at least a portion of the mandrel generally upward from the lower housing, wherein the plurality of slip segments are configurable between a radially retracted position and a radially expanded position.

A third embodiment, which is the wellbore servicing tool of the second embodiment, wherein the plurality of slip segments are disposed about the portion of the mandrel generally downward from the packer element.

A fourth embodiment, which is the wellbore servicing tool of one of the second through the third embodiments, further comprising a slip retainer.

A fifth embodiment, which is the wellbore servicing tool of one of the first through the fourth embodiments, wherein the wellbore servicing tool is configured to selectively be coupled to a setting tool.

A sixth embodiment, which is the wellbore servicing tool of the fifth embodiment, wherein the upper housing comprises a housing-tool interface, wherein the housing-tool interface engages a housing-engagement member of the setting tool.

A seventh embodiment, which is the wellbore servicing tool of the sixth embodiment, wherein the housing-tool interface comprises a groove, a slot, a notch, or combinations thereof, and wherein the housing-engagement member comprises a radially outward biased torque key, lug, pin, extendable member, or combinations thereof.

An eighth embodiment, which is the wellbore servicing tool of one of the fifth through the seventh embodiments, wherein the mandrel comprises a mandrel-tool interface, wherein the mandrel-tool interface engages a mandrel-engagement member of the setting tool.

A ninth embodiment, which is the wellbore servicing tool of the eighth embodiment, wherein the mandrel-tool interface comprises a groove, a slot, a notch, or combinations thereof, and wherein the mandrel-engagement member comprises a radially outward biased torque key, lug, pin, extendable member, or combinations thereof.

A tenth embodiment, which is the wellbore servicing tool of one of the first through the ninth embodiments, wherein the upper housing comprises a first one or more ports, wherein the lower housing comprises a second one or more ports, wherein the first one or more ports and the second one or more ports provide a route of fluid communication between the axial flowbore and an exterior of the wellbore servicing tool when the wellbore servicing tool is in the unset configuration and wherein the first one or more ports and the second one or more ports does not provide the route of fluid communication between the axial flowbore and an exterior of the wellbore servicing tool when the wellbore servicing tool is in the set configuration.

An eleventh embodiment, which is a wellbore servicing system comprising:

a setting tool disposed within a wellbore; and a wellbore isolation tool selectively coupled to the setting tool and comprising:

a mandrel generally defining an axial flowbore and an outer cylindrical surface, at least a portion of the outer cylindrical surface comprising a threaded exterior surface;

an upper housing generally defining a first inner cylindrical surface, at least a portion of the first inner cylindrical surface comprising a threaded interior surface, wherein the upper housing is movably positioned about at least a portion of the mandrel such that the threaded exterior surface at least partially engages the threaded interior surface;

a packer element exhibiting radial expansion upon being longitudinally compressed, wherein the packer element is movably positioned about at least a portion of the mandrel generally downward relative to the upper housing; and a lower housing generally defining a second inner cylindrical surface, wherein the lower housing is movably positioned about at least a portion of the mandrel, wherein the wellbore isolation tool is selectively transitionable from an unset configuration to a set configuration upon a decrease in longitudinal distance between the upper housing and the lower housing along the mandrel, wherein the wellbore isolation tool is selectively transitionable from the set configuration to the unset configuration upon an increase in longitudinal distance between the upper housing and the lower housing, and wherein the rotation of the upper housing with respect to the mandrel moves decreases the longitudinal distance between the upper housing and the lower housing along the mandrel or increases longitudinal distance between the upper housing and the lower housing along the mandrel.

A twelfth embodiment, which is the wellbore servicing system of the eleventh embodiment, wherein the wellbore is cased.

A thirteenth embodiment, which is the wellbore servicing system of one of the eleventh through the twelfth embodiments, wherein the upper housing comprises a housing-tool interface, wherein the setting tool comprises a housing-engagement member, and wherein the housing-tool interface engages the housing-engagement member.

A fourteenth embodiment, which is the wellbore servicing tool of the thirteenth embodiment, wherein the housing-tool interface comprises a groove, a slot, a notch, or combinations thereof, and wherein the housing-engagement member comprises a radially outward biased torque key, lug, pin, extendable member, or combinations thereof.

A fifteenth embodiment, which is the wellbore servicing tool of one of the thirteenth through the fourteenth embodiments, wherein the mandrel comprises a mandrel-tool interface, wherein the setting tool comprises a mandrel-engagement member, and wherein the mandrel-tool interface engages the mandrel-engagement member.

A sixteenth embodiment, which is the wellbore servicing tool of the fifteenth embodiment, wherein the mandrel-tool interface comprises a groove, a slot, a notch, or combinations thereof, and wherein the mandrel-engagement member comprises a radially outward biased torque key, lug, pin, extendable member, or combinations thereof.

A seventeenth embodiment, which is the wellbore servicing tool of one of the fifteenth through the sixteenth embodiments, wherein the setting tool is selectively actuatable, wherein, upon actuation of the setting tool, the housing-engagement member rotates with respect to the mandrel-engagement member.

An eighteenth embodiment, which is a wellbore servicing method comprising:

positioning a wellbore isolation tool within a wellbore, wherein the wellbore isolation tool is positioned within the wellbore selectively coupled to a setting tool; and setting the wellbore isolation tool, wherein setting the wellbore isolation tool comprises causing an upper housing of the wellbore isolation tool to rotate with respect to a mandrel of the wellbore isolation tool.

A nineteenth embodiment, which is the wellbore servicing method of the eighteenth embodiment, further comprising uncoupling the setting tool from the wellbore isolation tool and removing the setting tool from the wellbore.

A twentieth embodiment, which is the wellbore servicing method of the nineteenth embodiment, further comprising applying a fluid pressure to a first portion of the wellbore, wherein the wellbore isolation tool is effective to fluidicly isolate the first portion of the wellbore from a second portion of the wellbore.

A twenty-first embodiment, which is the wellbore servicing method of one of the nineteenth through the twentieth embodiments, further comprising reintroducing the setting tool into the wellbore.

A twenty-second embodiment, which is the wellbore servicing method of the twenty-first embodiment, further comprising coupling the setting tool to the wellbore isolation tool.

A twenty-third embodiment, which is the wellbore servicing method of the twenty-second, further comprising unsetting the wellbore isolation tool, wherein unsetting the wellbore isolation tool comprises causing the upper housing of the wellbore isolation tool to rotate with respect to the mandrel of the wellbore isolation tool.

A twenty-fourth embodiment, which is the wellbore servicing method of the twenty-third embodiment, wherein setting the wellbore isolation tool comprises causing an upper housing of the wellbore isolation tool to rotate in a first direction with respect to a mandrel of the wellbore isolation tool, wherein unsetting the wellbore isolation tool comprises causing the upper housing of the wellbore isolation tool to rotate in a second direction with respect to the mandrel of the wellbore isolation tool, and wherein the first direction is the opposite of the second direction.

A twenty-fifth embodiment, which is the wellbore servicing method of one of the eighteenth through the twenty-fourth embodiments, wherein the wellbore isolation tool comprises:

a mandrel generally defining an axial flowbore and an outer cylindrical surface, at least a portion of the outer cylindrical surface comprising a threaded exterior surface;

an upper housing generally defining a first inner cylindrical surface, at least a portion of the first inner cylindrical surface comprising a threaded interior surface, wherein the upper housing is movably positioned about at least a portion of the mandrel such that the threaded exterior surface at least partially engages the threaded interior surface;

a packer element exhibiting radial expansion upon being longitudinally compressed, wherein the packer element is movably positioned about at least a portion of the mandrel generally downward relative to the upper housing; and a lower housing generally defining a second inner cylindrical surface, wherein the lower housing is movably positioned about at least a portion of the mandrel, wherein the wellbore servicing tool is selectively transitionable from an unset configuration to a set configuration upon a decrease in longitudinal distance between the upper housing and the lower housing along the mandrel, wherein the wellbore isolation tool is selectively transitionable from the set configuration to the unset configuration upon an increase in longitudinal distance between the upper housing and the lower housing, and wherein the rotation of the upper housing with respect to the mandrel decreases the longitudinal distance between the upper housing and the lower housing along the mandrel or increases longitudinal distance between the upper housing and the lower housing along the mandrel.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing tool comprising:

a mandrel generally defining an axial flowbore and an outer cylindrical surface, at least a portion of the outer cylindrical surface comprising a threaded exterior surface;

an upper housing comprising a first inner cylindrical surface, that comprises a threaded interior surface and a housing-tool interface that is structured and arranged to engage a housing-engagement member of a setting tool and, wherein the upper housing is movably positioned about at least a portion of the mandrel such that the threaded exterior surface at least partially engages the threaded interior surface;

a packer element exhibiting radial expansion upon being longitudinally compressed, wherein the packer element is movably positioned about at least a portion of the mandrel generally downward relative to the upper housing; and a lower housing generally defining a second inner cylindrical surface, wherein the lower housing is movably positioned about at least a portion of the mandrel, wherein the wellbore servicing tool is selectively transitionable from an unset configuration to a set configuration upon a decrease in longitudinal distance between the upper housing and the lower housing along the mandrel, wherein the wellbore servicing tool is selectively transitionable from the set configuration to the unset configuration upon an increase in longitudinal distance between the upper housing and the lower housing, and wherein the rotation of the upper housing with respect to the mandrel in a setting direction decreases the longitudinal distance between the upper housing and the lower housing along the mandrel; and wherein the packer element is radially expanded in the set configuration.

2. The wellbore servicing tool of claim 1, further comprising a plurality of slip segments disposed about at least a portion of the mandrel generally upward from the lower housing, wherein the plurality of slip segments are configurable between a radially retracted position and a radially expanded position.

3. The wellbore servicing tool of claim 2, wherein the plurality of slip segments are disposed about the portion of the mandrel generally downward from the packer element.

4. The wellbore servicing tool of claim 2, further comprising a slip retainer.

5. The wellbore servicing tool of claim 1, wherein the wellbore servicing tool is configured to be selectively coupled to the setting tool.

6. The wellbore servicing tool of claim 5, wherein the mandrel comprises a mandrel-tool interface, wherein the mandrel-tool interface engages a mandrel-engagement member of the setting tool.

7. The wellbore servicing tool of claim 6, wherein the mandrel-tool interface comprises a groove, a slot, a notch, or combinations thereof, and wherein the mandrel-engagement member comprises a radially outward biased torque key, lug, pin, extendable member, or combinations thereof.

8. The wellbore servicing tool of claim 1, wherein the housing-tool interface comprises a groove, a slot, a notch, or combinations thereof, and wherein the housing-engagement member comprises a radially outward biased torque key, lug, pin, extendable member, or combinations thereof.

9. The wellbore servicing tool of claim 1, wherein the upper housing comprises a first one or more ports, wherein the lower housing comprises a second one or more ports, wherein the first one or more ports and the second one or more ports provide a route of fluid communication between the axial flowbore and an exterior of the wellbore servicing tool when the wellbore servicing tool is in the unset configuration and wherein the first one or more ports and the second one or more ports does not provide the route of fluid communication between the axial flowbore and an exterior of the wellbore servicing tool when the wellbore servicing tool is in the set configuration.

10. A wellbore servicing system comprising:

a setting tool disposed within a wellbore; and a wellbore isolation tool selectively coupled to the setting tool and comprising:

a mandrel generally defining an axial flowbore and an outer cylindrical surface, at least a portion of the outer cylindrical surface comprising a threaded exterior surface;

an upper housing comprising a first inner cylindrical surface, that comprises a threaded interior surface and a housing-tool interface that is structured and arranged to engage a housing-engagement member of a setting tool and, wherein the upper housing is movably positioned about at least a portion of the mandrel such that the threaded exterior surface at least partially engages the threaded interior surface;

a packer element exhibiting radial expansion upon being longitudinally compressed, wherein the packer element is movably positioned about at least a portion of the mandrel generally downward relative to the upper housing; and a lower housing generally defining a second inner cylindrical surface, wherein the lower housing is movably positioned about at least a portion of the mandrel, wherein the wellbore isolation tool is selectively transitionable from an unset configuration to a set configuration upon a decrease in longitudinal distance between the upper housing and the lower housing along the mandrel, wherein the wellbore isolation tool is selectively transitionable from the set configuration to the unset configuration upon an increase in longitudinal distance between the upper housing and the lower housing, and wherein the rotation of the upper housing with respect to the mandrel in a setting direction decreases the longitudinal distance between the upper housing and the lower housing along the mandrel.

11. The wellbore servicing system of claim 10, wherein the wellbore is cased.

12. The wellbore servicing tool of claim 10, wherein the housing-tool interface comprises a groove, a slot, a notch, or combinations thereof, and wherein the housing-engagement member comprises a radially outward biased torque key, lug, pin, extendable member, or combinations thereof.

13. The wellbore servicing tool of claim 10, wherein the mandrel comprises a mandrel-tool interface, wherein the setting tool comprises a mandrel-engagement member, and wherein the mandrel-tool interface engages the mandrel-engagement member.

14. The wellbore servicing tool of claim 13, wherein the mandrel-tool interface comprises a groove, a slot, a notch, or combinations thereof, and wherein the mandrel-engagement member comprises a radially outward biased torque key, lug, pin, extendable member, or combinations thereof.

15. A wellbore servicing method comprising:

positioning a wellbore isolation tool within a wellbore, wherein the wellbore isolation tool is positioned within the wellbore selectively coupled to a setting tool;

engaging a housing-tool interface disposed on an inner cylindrical surface of an upper tool housing of the wellbore isolation tool with a housing-engagement member of the setting tool; and setting the wellbore isolation tool comprising rotating the upper housing of the wellbore isolation tool about an exterior of a mandrel of the wellbore isolation tool in a setting direction, wherein rotating the upper housing in the setting direction radially expands a packer element.

16. The wellbore servicing method of claim 15, further comprising uncoupling the setting tool from the wellbore isolation tool and removing the setting tool from the wellbore.

17. The wellbore servicing method of claim 16, further comprising applying a fluid pressure to a first portion of the wellbore, wherein the wellbore isolation tool is effective to fluidically isolate the first portion of the wellbore from a second portion of the wellbore.

18. The wellbore servicing method of claim 16, further comprising reintroducing the setting tool into the wellbore.

19. The wellbore servicing method of claim 18, further comprising coupling the setting tool to the wellbore isolation tool.

20. The wellbore servicing method of claim 19, further comprising unsetting the wellbore isolation tool, wherein unsetting the wellbore isolation tool comprises causing the upper housing of the wellbore isolation tool to rotate opposite the setting direction with respect to the mandrel of the wellbore isolation tool.

* * * * *